US007195070B2

(12) United States Patent
Delaloye et al.

(10) Patent No.: US 7,195,070 B2
(45) Date of Patent: Mar. 27, 2007

(54) METHOD AND APPARATUS FOR DOWNHOLE ARTIFICIAL LIFT SYSTEM PROTECTION

(75) Inventors: Richard J. Delaloye, Sugarland, TX (US); Steven C. Kennedy, Houston, TX (US); Jeffrey Bode, The Woodlands, TX (US); Jeffrey Lembcke, Cypress, TX (US); Kevin W. Smith, Houston, TX (US); Benjamin R. Luscomb, III, Houston, TX (US); Jack Curr, The Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 349 days.

(21) Appl. No.: 10/892,524

(22) Filed: Jul. 15, 2004

(65) Prior Publication Data

US 2006/0011345 A1 Jan. 19, 2006

(51) Int. Cl.
*E21B 43/22* (2006.01)

(52) U.S. Cl. ..... 166/304; 166/310; 166/902

(58) Field of Classification Search ..... 166/304, 166/305.1, 310, 902, 90.1
See application file for complete search history.

(56) References Cited

U.S. PATENT DOCUMENTS

| | | | | |
|---|---|---|---|---|
| 2,352,832 A | | 7/1944 | Gunderson | 166/21 |
| 2,437,475 A | | 3/1948 | Oxford, Jr. | 252/8.55 |
| 4,032,457 A | * | 6/1977 | Matchett | 210/489 |
| 4,977,958 A | | 12/1990 | Miller | 166/205 |
| 5,758,725 A | * | 6/1998 | Streetman | 166/304 |
| 5,893,416 A | | 4/1999 | Read | 166/304 |
| 6,216,788 B1 | | 4/2001 | Wilson | 166/311 |
| 6,394,185 B1 | | 5/2002 | Constien | 166/296 |
| 6,599,863 B1 | | 7/2003 | Palmer et al. | 507/219 |
| 6,638,896 B1 | | 10/2003 | Tibbles et al. | 507/201 |

(Continued)

OTHER PUBLICATIONS

W.L. Nehmer, et al. "Viscoelastic Gravel-Pack Carrier Fluid." Society of Petroleum Engineers, SPE 17168, 1988, pp. 217-226.
B.R. Stewart, et al. "Use of a Solids-free Viscous Carrying Fluid in Fracturing Applications: An Economic and Productivity Comparison in Shallow Completions," Society of Petroleum Engineers, SPE 17168, 1994, pp. 379-392.
Baker Hughes XTEND Continuous Protection Program [web page] 2004; http://www.bakerhughes.com/bakerpetrolite/oilgas/corrosion/xtend.htm. [Accessed Jan. 20, 2004].

(Continued)

*Primary Examiner*—William Neuder
(74) *Attorney, Agent, or Firm*—Wong, Cabello, Lutsch, Rutherford & Brucculeri, LLP

(57) ABSTRACT

A fluid conditioning system designed to be installed between the well perforation and the intake of a pump used to effect artificial lift is used to filter and chemically treat production fluids. The fluid conditioning system is an apparatus that provides scale inhibitors and/or other chemical treatments into the production stream. In some embodiments, the fluid conditioning system may be a part of the production stream filter wherein the filtering material is comprised of a porous medium that contains and supports the treatment chemical. In other embodiments, the chemical treatment may be accomplished by the gradual dissolution of a solid phase chemical. The treating chemical may be recharged or replenished by various downhole reservoirs or feeding means. In yet other embodiments, the treating chemical may be replenished from the surface by means of a capillary tube. In certain other embodiments, the apparatus may be retrievable from the surface thereby permitting recharge or replenishment of the chemical in the apparatus on an as-needed basis. The filtration apparatus may incorporate a by-pass valve that allows fluid to by-pass the filter as sand or other particulate matter fills up or blocks the filter.

102 Claims, 15 Drawing Sheets

U.S. PATENT DOCUMENTS

| | | | | |
|---|---|---|---|---|
| 6,706,196 | B2 * | 3/2004 | Holland | 210/695 |
| 2002/0020527 | A1 | 2/2002 | Kilaas et al. | 166/250.01 |
| 2003/0079876 | A1 * | 5/2003 | Underdown | 166/265 |
| 2003/0131997 | A1 | 7/2003 | Chatterji et al. | 166/278 |
| 2004/0084186 | A1 * | 5/2004 | Allison | 166/305.1 |
| 2005/0022994 | A1 * | 2/2005 | Wilson | 166/305.1 |

OTHER PUBLICATIONS

UNICO Electric Submersible Pump Drive, Brochure, Unico, Inc. 3725 Nicholson Rd., Franksville, Wisconsin 53126, Jul. 2005.

Sandcat Downhole ESP Desander System and Sand Management System, Pumptools Brochure, Pump Tools Ltd. Bluewater House, Howe Moss Drive, Dyce, Aberdeen, Scotland AB21 OGL.

* cited by examiner

METHOD AND APPARATUS FOR DOWNHOLE ARTIFICIAL LIFT SYSTEM PROTECTION

BACKGROUND

1. Field of the Invention

This invention relates to oil and gas well production technology. More particularly, it relates to the in situ treatment of fluids produced by an artificial lift oil well to inhibit the formation of scale inside and outside of production tubing, pumps, valves, and the like and to reduce the amount of solids that enter the pump.

2. Description of the Related Art

A typical oil well produces not only oil, but also gas and water, often in significant quantity. The fluids often transport solids, such as sand, as well as other potentially damaging fluids and gases, from the reservoir into the production tubing and casing, and up the production tubing to the surface. Equipment on the surface may be used to separate these production components. The oil is recovered; the gas, depending on its composition, may be filtered, treated and piped to a collection facility or flared off; the water may be re-injected into another formation or, in the case of offshore production platforms, treated to prevent environmental contamination and then discharged overboard; and the solids are separated and disposed of.

The oil and water produced by oil and gas wells often contains significant quantities of dissolved minerals. Frequently, the water is saturated with these minerals—i.e., the water contains the maximum concentration of the dissolved minerals possible at a given temperature and pressure. Changes in temperature and/or pressure which occur as the fluid is pumped from the production zone through the well to the treatment equipment on the surface can cause the minerals to come out of solution ("precipitate") and become deposited on the interior and exterior surfaces of the production tubing, pumps, valves, chokes and other equipment. The deposit is known as "scale" and it can significantly reduce the diameter and hence the capacity of production tubing. In extreme cases, the pipe or tubing can become completely obstructed, shutting down production. Even in less severe cases, where the fluid is not saturated, scale can build up on the interior and exterior of any exposed surface.

Certain dissolved minerals in water are known as "hardness ions"—divalent cations that include calcium ($Ca^{+2}$), magnesium ($Mg^{+2}$) and ferrous ($Fe^{+2}$) ions. Hardness ions develop from dissolved minerals, bicarbonate, carbonate, sulfate and chloride. Heating water containing bicarbonate salts can cause the precipitation of a calcium carbonate solid. Raising the pH can allow the $Mg^{+2}$ and $Fe^{+2}$ ions to precipitate as $Fe(OH)_2$ and $Mg(OH)_2$. Excess sodium carbonate can precipitate $Ca^{+2}$ as $CaCO_3$.

Precipitation is the formation of an insoluble material in a solution. Precipitation may occur by a chemical reaction of two or more ions in solution or by changing the temperature of a saturated solution. There are many examples of this important phenomenon in drilling fluids. Precipitation occurs in the reaction between calcium cations and carbonate anions to form insoluble calcium carbonate: $Ca^{+2}+CO_3^{-2}\rightarrow CaCO_3$.

Scale is a mineral salt deposit or coating formed on the surface of metal, rock or other material. Scale may be caused by a precipitation resulting from a chemical reaction with the surface on which it forms, precipitation caused by chemical reactions, a change in pressure or temperature, or a change in the composition of a solution. The term "scale" is also applied to a corrosion product. Typical scales are calcium carbonate, calcium sulfate, barium sulfate, strontium sulfate, iron sulfide, iron oxides, iron carbonate, the various silicates and phosphates and oxides, or any of a number of compounds insoluble or slightly soluble in water.

Scale may be deposited on wellbore tubulars, down hole equipment, and related components as the saturation of produced water is affected by changing temperature and pressure conditions in the production conduit. In severe conditions, scale creates a significant restriction, or even a plug, in the production tubing. Scale build-up in the artificial lift pump can lead to failure of the pump due to blocked flow passages and broken shafts. Scale removal is a common well-intervention operation. A wide range of mechanical, chemical and scale inhibitor treatment options are available to effect scale removal.

Scale can also occur in tubing, the gravel pack, the perforations or the formation itself Scale deposition occurs when the solution equilibrium of the water is disturbed by pressure and temperature changes, dissolved gases or incompatibility between mixing waters. Scale deposits are the most common and most troublesome damage problems in the oil field and can occur in both production and injection wells.

All waters used in well operations can be potential sources of scale, including water used in waterflood operations and filtrate from completion, workover or treating fluids. Therefore, reduction of scale deposition is directly related to reducing the amount of bad water that is produced.

Carbonate scale is usually granular and sometimes very porous. A carbonate scale can be easily identified by dropping it in a solution of hydrochloric acid where bubbles of carbon dioxide will be observed effervescing from the surface of the scale. Sulphate scales are harder and more dense. A sulphate deposit is brittle and does not effervesce when dropped in acid. Silica scales resemble porcelain—they are very brittle, not soluble in acid, but dissolve slowly in alkali.

Scale removal is a common well-intervention operation involving a wide variety of mechanical scale-inhibitor treatments and chemical options. Mechanical removal may be done by means of a pig or by abrasive jetting that cuts scale but leaves the tubing intact. Scale-inhibition treatments involve squeezing a chemical inhibitor into a water-producing zone for subsequent commingling with produced fluids, preventing further scale precipitation. Chemical removal is performed with different solvents according to the type of scale:

- Carbonate scales such as calcium carbonate or calcite [$CaCO_3$] can be readily dissolved with hydrochloric acid [HCl] at temperatures less than 250° F. [121° C.].
- Sulfate scales such as gypsum [$CaSO_4.2H_2O$] or anhydrite [$CaSO_4$] can be readily dissolved using ethylenediamine tetraacetic acid (EDTA). The dissolution of barytine [$BaSO_4$] or strontianite [$SrSO_4$] is much more difficult.
- Chloride scales such as sodium chloride [NaCl] are easily dissolved with fresh water or weak acidic solutions, including HCl or acetic acid.
- Iron scales such as iron sulfide [FeS] or iron oxide [$Fe_2O_3$] can be dissolved using HCl with sequestering or reducing agents to avoid precipitation of by-products, for example iron hydroxides and elemental sulfur.
- Silica scales such as crystallized deposits of chalcedony or amorphous opal normally associated with steamflood projects can be dissolved with hydrofluoric acid [HF].

Calcium scales such as calcium sulfate, calcium carbonate and calcium oxalate are insoluble in water. However, all three are soluble in a Sodium Bisulfate acid solution. Calcium scale can be removed with an acid wash using a 5–15% solution of Sodium Bisulfate (SBS). SBS can also be used during a shut down to remove scale by re-circulating it throughout areas of the process where needed. The concentration of SBS solutions and the re-circulation time depend on the amount of scale that needs to be removed. SBS can be a substitute for sulfamic acid in calcium scale removal situations.

Zinc sulfide (ZnS) is another one of the oil field scales that plagues production. Although it does not seem to be common, according to field experience and published literature, it causes a significant flow/production problem when it does occur, just as all other scales adversely affect wells. Other scales, such as barium sulfate and strontium sulfate, also cause production problems but are much harder than ZnS.

Although chemical solvents have been used on these harder scales, the results are often disappointing. While mechanical scale removal has been used successfully on barium and strontium sulfate scales with excellent success, it had not been used on ZnS scale. It was conceivable that the softer scale may not respond to the same process that removed harder scales.

In certain cases, scale may be an environmental or health hazard. The State of Louisiana, Department of Environmental Quality has issued a notification concerning a potential health hazard associated with handling pipe used in oil and gas production that may be contaminated with radioactive scale from naturally-occurring radioactive materials (NORM). The concern is the possible inhalation and/or ingestion of scale particles contaminated with radium-226 and possibly other radioactive material that may become airborne during welding, cutting or reaming pipe that contains radioactive scale. The State of Louisiana is using the term Technologically Enhanced Natural Radiation (TENR) for this material that is a subset of the NORM group.

An inhibitor is a chemical agent added to a fluid system to retard or prevent an undesirable reaction that occurs within the fluid or with the materials present in the surrounding environment. A range of inhibitors is commonly used in the production and servicing of oil and gas wells, such as corrosion inhibitors used in acidizing treatments to prevent damage to wellbore components and inhibitors used during production to control the effect of hydrogen sulfide [$H_2S$]

A scale inhibitor is a chemical agent added to a fluid system to retard or prevent an undesirable reaction that occurs within the fluid or with the materials present in the surrounding environment. A range of inhibitors is commonly used in the production and servicing of oil and gas wells, such as corrosion inhibitors used in acidizing treatments to prevent damage to wellbore components and inhibitors used during production to control the effect of hydrogen sulfide [$H_2S$]

A sequestering agent (or chelation agent) is a chemical whose molecular structure can envelop and hold a certain type of ion in a stable and soluble complex. Divalent cations, such as hardness ions, form stable and soluble complex structures with several types of sequestering chemicals. When held inside the complex, the ions have a limited ability to react with other ions, clays or polymers. Ethylenediamine tetraacetic acid (EDTA) is a well-known sequestering agent for the hardness ions, such as $Ca^{+2}$, and is the reagent solution used in the hardness test protocol published by API. Polyphosphates can also sequester hardness ions. Sequestering is not the same as precipitation because sequestering does not form a solid. For calcium carbonate deposits, glycolic and citric acids and ammonium salts and blends incorporating EDTA are used as chelants.

A scale-inhibitor squeeze is a type of inhibition treatment used to control or prevent scale deposition. In a scale-inhibitor squeeze, the inhibitor is pumped into a water-producing zone. The inhibitor is attached to the formation matrix by chemical adsorption or by temperature-activated precipitation and returns with the produced fluid at sufficiently high concentrations to avoid scale precipitation. Some chemicals used in scale-inhibitor squeezes are phosphonated carboxylic acids or various polymers.

Some scale-inhibitor systems integrate scale inhibitors and fracture treatments into one step, which guarantees that the entire well is treated with scale inhibitor. In this type of treatment, a high-efficiency scale inhibitor is pumped into the matrix surrounding the fracture face during leakoff. It adsorbs to the matrix during pumping until the fracture begins to produce water. As water passes through the inhibitor-adsorbed zone, it dissolves sufficient inhibitor to prevent scale deposition. The inhibitor is better placed than in a conventional scale-inhibitor squeeze, which reduces the re-treatment cost and improves production.

Some well treatment systems continuously inject the treating chemical in the well using a metering pump. The chemicals are either injected below the pump using a capillary line or injected into the well annulus. When chemicals are injected into the well annulus the chemicals build up in the well bore until the pump pulls them down the wellbore and into the pump intake.

Due to the time that it takes for the chemicals to reach the pump, changes in chemical mix or injection rates are very slow to affect the fluids entering the pump. If the pump intake is above the electric motor in an Electric Submersible Pump, ESP installation, the chemicals do not protect the motor or the casing below the pump intake.

In capillary injection systems, the location of the chemical injection can be determined when the system is installed by terminating the capillary tube below the pump intake/motor combination in an ESP completion. The capillary injection tube provides continuous treatment of the fluids and the time delay for adjustments to the blend of chemicals and/or treatment rate can be minimized.

Sand produced with the fluids can cause damage to pumping systems. Abrasion resistant pumps with engineered ceramic bearings and coated flow passages have been developed to improve pump life in wells that produce sand, but sand will eventually wear out even these special sand-tolerant pumps.

One practice for removing sand from the fluid is by installing a liquid and sand separator between the casing perforations and the pump intake. These systems deposit the separated sand into the well's rat hole or into tubing hung from the bottom of the separator as a trap. Wilson discloses a means for removal of sand separated with a downhole sand separator in U.S. Pat. No. 6,216,788.

Gravel packing is a sand-control method used to prevent the production of formation sand. It involves the placement of selected gravel across the production interval to prevent the production of formation fines or sand. Any gap or interruption in the pack coverage may permit undesirable sand or fines to enter the producing system.

In gravel pack operations, a steel screen is placed in the wellbore and the surrounding annulus is then packed with prepared gravel of a specific size that is designed to prevent the passage of formation sand. The primary objective is to stabilize the formation while causing minimal impairment to well productivity.

Wire-wrapped screen is one type of screen used in sand control applications to support the gravel pack. The profiled wire is wrapped and welded in place on a perforated liner. Wire-wrapped screen is available in a range of sizes and specifications, including outside diameter, material type and the geometry and dimension of the screen slots. The space between each wire wrap must be small enough to retain the gravel placed behind the screen, yet minimize any restriction of production.

A sand filter as described by Stanley in U.S. Pat. No. 4,977,958 is used to filter the sand out of the fluid prior to entering the pump intake. This style of intake filter has been installed in numerous wells and is effective for removal of solids, but once the filter is full of sand, fluid flow through the filter is restricted and a large pressure drop occurs. As the pressure drop increases, the rate of sand accumulation increases causing the rate of pressure drop to increase until eventually the fluid flow across the filter ceases. When fluid flow to the pump ceases, the pump will cavitate and eventually fail.

SUMMARY OF THE INVENTION

A fluid conditioning system is installed between the well perforations and the intake of a pump used to effect artificial lift. The fluid conditioning system is an apparatus that provides scale inhibitors and/or other chemical treatments into the production stream. The production stream may also be filtered by the apparatus prior to the production stream's introduction into the pump. In some embodiments, the fluid conditioning system may be a part of the production stream filter wherein the filtering material is comprised of a porous medium that contains and supports the treatment chemical. In other embodiments, the chemical treatment may be accomplished by the gradual dissolution of the unsupported solid phase chemical itself The treating chemical may be recharged or replenished by various downhole reservoirs or feeding means. In yet other embodiments, the chemical treatment may be replenished from the surface by means of a capillary tube. In certain other embodiments, the apparatus may be retrievable from the surface by means of a wireline or coil tubing thereby permitting recharge or replenishment of the chemical in the apparatus on an as-needed or periodic basis. The filtration apparatus may incorporate a by-pass valve that allows fluid to by-pass the filter as sand or other particulate matter fills up or blocks the filter.

BRIEF DESCRIPTION OF THE DRAWING FIGURES

DETAILED DESCRIPTION OF THE INVENTION

Advances in electric motor technology have made Electric Submersible Pumps (ESPs) an increasingly popular method of providing artificial lift for oil wells. Operating in the harsh conditions of the downhole environment, an ESP must be protected from ingesting corrosive, abrasive, or any other detrimental substance in the production fluids in order to provide a Mean Time Between Failure (MTBF) that justifies its use on an economic basis. In addition, treating the production fluids while downhole minimizes the potential hazards involved in bringing the production fluids to the surface while the production fluids may contain any detrimental substance. Moreover, scale build-up in production tubing and pump chambers must also be controlled in order to decrease the number of well interventions or workovers needed during the useful life of an oil well.

The present invention is a novel apparatus and method which combines the functions of preventing fines or sand from entering the pump with the introduction of a scale inhibitor or other chemical treatments into the production stream prior to entering the pump. In an alternative embodiment the production stream may be treated for environmental hazards after entering the pump.

Figure 1:
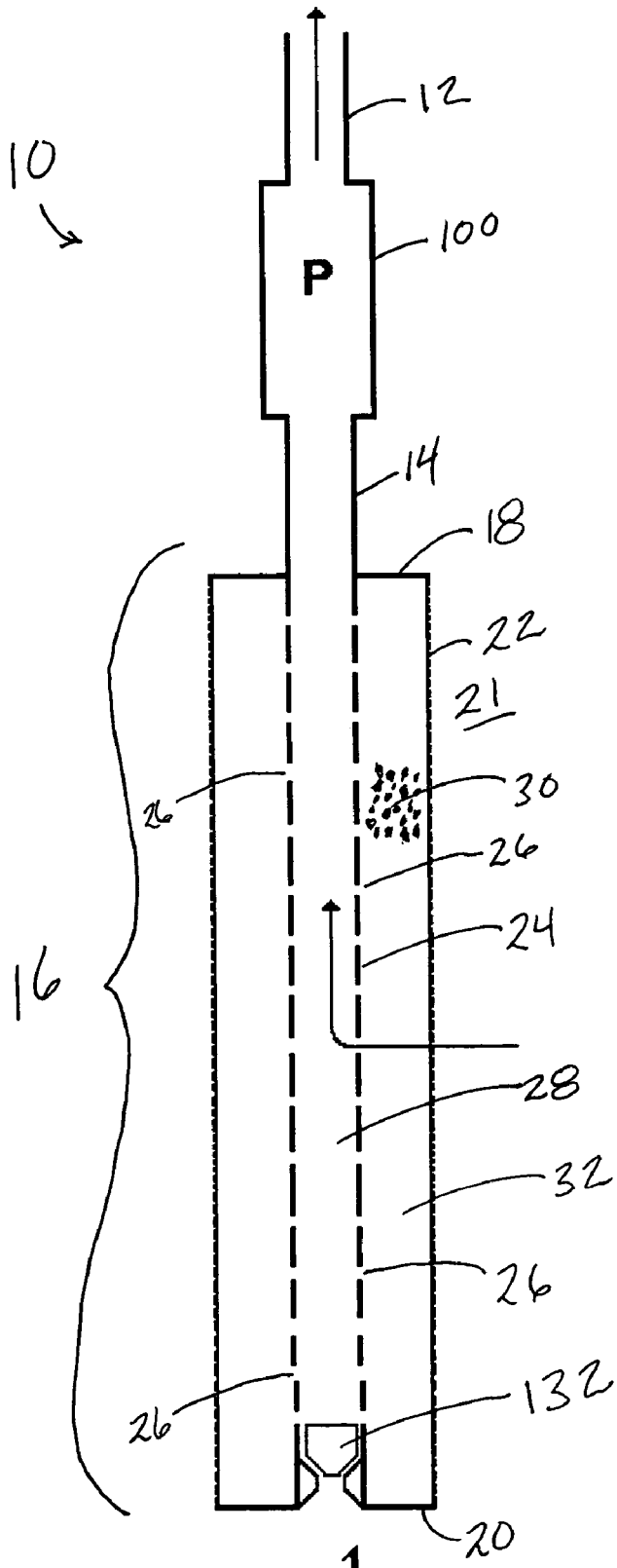
FIG. 1 is a cross-sectional view of an artificial lift pump equipped with an intake screen having a single-layer treatment space.

Referring now to FIG. 1, artificial lift system 10 includes pump 100 attached at its outlet end to production tubing 12 and at its inlet to inlet connector 14 which is in fluid communication with filter assembly 16. Filter assembly 16 is preferably designed such that wellbore fluid will pass from the exterior 21 of external tubular 22 through external tubular 22 through any medium 30 through internal tubular 24 and into the central passage 28 of internal tubular 24. Artificial lift system 10 may be generally circular in cross section and sized to fit within the production casing of a well [not shown]. In some embodiments, pump 100 may be an ESP that receives electrical power from the surface via an electrical cable within the well bore [not shown].

Filter assembly 16 comprises top plate 18 and bottom plate 20. Top plate 18 allows internal tubular 24 to pass through its center portion and may be joined to inlet connector 14 in a fluid tight manner. Top plate 18 and bottom plate 20 are connected by an external tubular 22 and by an internal tubular 24. The external tubular 22 may be a screen or other type of porous structure that allows a desired wellbore fluid to pass from one side of the tubular to the other while restraining the passage of undesired wellbore fluids or solids. The internal tubular 24 may be a screen or other type of porous structure that allows a desired wellbore fluid to pass from one side of the tubular to the other while restraining the passage of undesired wellbore fluids or solids. Together, external tubular 22 and internal tubular 24 define annular space 32 which may be used to contain medium 30 [partially shown in FIG. 1 for clarity].

Figure 2:
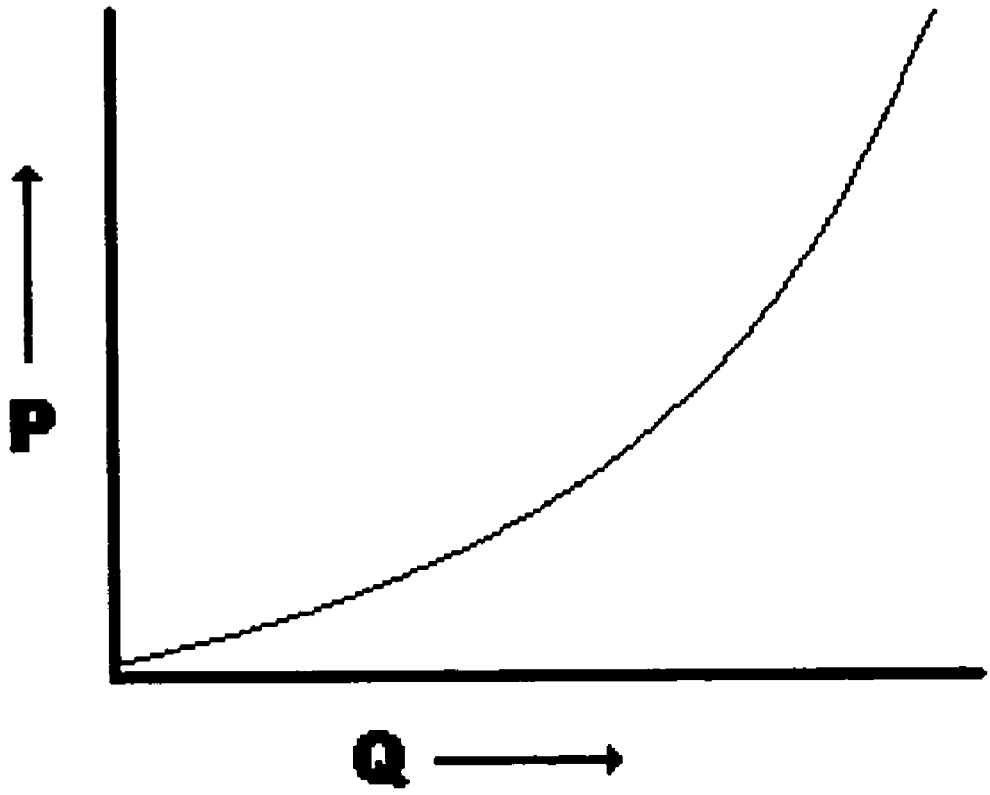
FIG. 2 is a typical flow curve for a by-pass valve.

Should the filter assembly 16 become at least partially clogged with solid or other matter that may be present in the wellbore such that wellbore fluid can no longer pass through the filter assembly 16 and reach the artificial lift system 10 then the artificial lift system 10 may be severely damaged. Such damage may result from such causes as pump cavitation. In cases where the wellbore fluid is used to cool the artificial lift system's motor, a partially clogged filter assembly may reduce the flow of cooling wellbore fluid to the extent that motor overheating may also occur. In order to prevent such damage to the artificial lift system, a by-pass valve 132 may be installed. Typically, although not always, the bottom plate 20 may have an opening through its center that allows fluid to pass directly from the well-bore into the central passage 28 of the internal tubular 24. A by-pass valve 132 is located in the opening through the bottom plate 20. The by-pass valve 132 may be a ball valve, a spring-loaded valve, a poppet valve, a shear assembly, rupture disc, or any other type of valve that may be activated to relieve differential pressure. In some embodiments when the pressure drop across the screen equals the by-pass setting, the by-pass valve 132 partially opens and wellbore fluid is allowed to by-pass the filter assembly 16. As fluid by-passes the filter assembly 16, the flow rate through the filter is reduced; thus, the pressure drop is reduced for the matter-packed filter. With the by-pass valve 132 partially open, a portion of the wellbore fluid flows into the central passage 28 through the filter assembly and a portion flows into the central passage 28 through the by-pass valve 132. The proportions of wellbore fluid that pass through the filter assembly 16 and the by-pass valve 132 can be represented by Q (total flow)=Qf (flow through filter assembly)+Qb (by-pass flow). As time passes, Qf will be reduced as more wellbore matter packs into the filter assembly 16 and the P (pressure) drop increases for a given flow rate thus causing Qb to increase. A typical flow curve is illustrated in FIG. 2. As the pressure drop across the filter assembly 16 increases, a larger fraction of the total flow passes through the bypass valve 132. Those skilled in the art will appreciate that different bypass valve designs will exhibit different flow curves. In an alternative embodiment, where a by-pass valve 132 is provided, the by-pass valve 132 could open just prior to the point at which wellbore fluid flow is reduced to the level that damage to the artificial lift system is predicted to occur. In addition, activation of the bypass valve should alert the operator on the surface that the filter assembly 16 might require service. Such service may be in the form of removal of the entire artificial lift system and filter assembly, reverse operation of the artificial lift system, or back-flushing fluid through the system from the surface so as to force out matter that may have accumulated in the filter assembly.

External tubular 22 may be any porous material with sufficient corrosion resistance and structural strength to withstand the torque, well obstructions, tension loading, compression loading, pressure differentials or any other conditions that may be encountered during insertion in the production casing and operation of the artificial lift system. In certain embodiments, external tubular 22 may be a wire mesh screen. In other embodiments, external tubular 22 may be a wire-wound screen. Stainless steels are a particularly preferred screen material owing to their mechanical strength and corrosion resistance. The screen may comprise a mechanical support for providing structural integrity. The screen may be selected to provide the desired opening size to exclude the sand and/or fines encountered in a particular well environment.

Internal tubular 24 may also be a screen or, in other embodiments, may comprise a pipe having openings or perforations 26. Openings 26 may also be size-selected for a particular application. Openings 26 may comprise holes or slots in the wall of internal tubular 24. Internal tubular 24 defines central passage 28 that is in fluid communication with inlet connector 14 of pump 100.

Annular space 32 may be occupied by medium 30 which may be a porous medium such as pumice—a highly-porous igneous rock, usually containing 67 to 75% $SiO_2$ and 10 to 20% $Al_2O_3$. Potassium, sodium and calcium are generally present. Pumice has a glassy texture. It is insoluble in water and not attacked by acids. It is commercially available in lump or powdered form (coarse, medium and fine).

Medium 30, when impregnated with a chemical agent, may be used to perform at least two functions: 1) mechanical filtration; and, 2) treatment of the fluid(s) flowing into the inlet of pump 100 with the chemical agent. The mechanical filtration function excludes sand, fines, and other wellbore matter, including highly viscous fluids that are not blocked by external tubular 22. The extent of this mechanical filtration is determined, at least in part, by the particle size and packing density of medium 30. Accordingly, the composition of medium 30, its particle size and its loading within annular space 32 may be optimized for various well conditions.

The size and configuration of openings 26 in internal tubular 24 may be optimally chosen to exclude medium 30 while providing the minimum restriction to flow of the production fluids. Alternatively, the size and configuration of openings 26 in internal tubular 24 may be chosen to provide another level of wellbore fluid filtration, where even smaller particles of matter are excluded from the central passage 28.

Top plate 18 and/or bottom plate 20 may be removable to facilitate charging filter assembly with medium 30.

In some embodiments, medium 30 may be the chemical agent in a solid form that slowly dissolves in the production fluids. In such embodiments, the physical filtering function of medium 30 dissipates over time and hence external tubular 22 and internal tubular 24 should be selected to provide sufficient sand, fines, or other matter exclusion to adequately protect pump 100.

Figure 3:
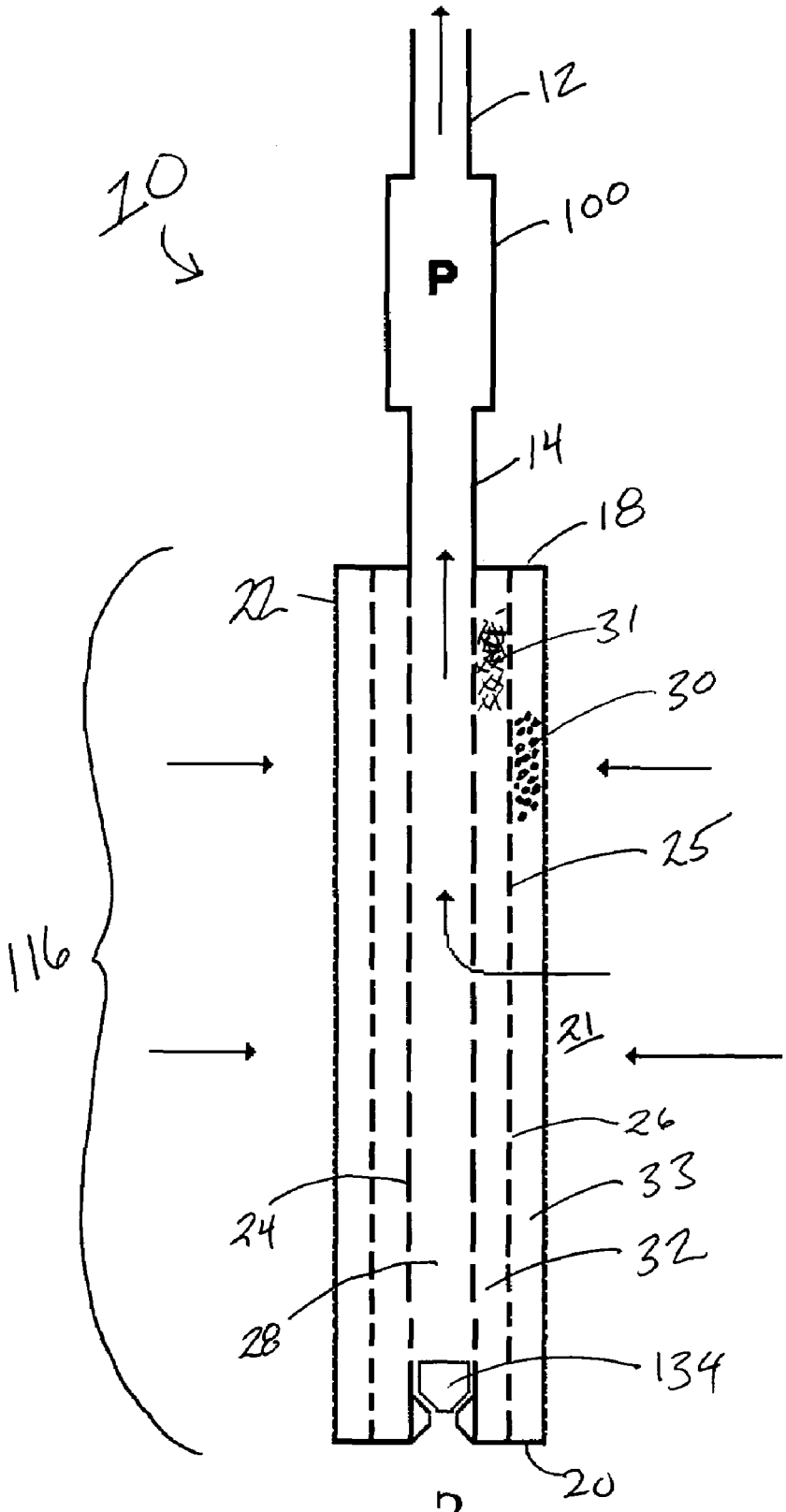
FIG. 3 is a cross-sectional view of an artificial lift pump equipped with an intake screen having at least two annular treatment spaces.

Referring now to FIG. 3, artificial lift system 10 includes pump 100 attached at its outlet end to production tubing 12 and at its inlet to inlet connector 14 which is in fluid communication with filter assembly 116. Filter assembly 116 includes one or more intermediate tubulars 25 [only a single intermediate tubular is shown for clarity] and thus filter assembly 116 has at least two annular spaces, 32 and 33. It will be appreciated by those skilled in the art that multiple intermediate walls may be incorporated into filter assembly 116 and thus multiple annular spaces may be defined within the apparatus. Each annular space may be used to contain a different medium to provide various functions—e.g., graduated mechanical filtration and/or treatment with different chemical agents. Intermediate wall 25 may comprise a screen, perforated tubular, or other type of porous material. The screen mesh or perforation size may be selected to substantially prevent medium 30 from entering annular space 32. Filter assembly 116 is preferably designed such that wellbore fluid will pass from the exterior 21 of external tubular 22 through external tubular 22 through any medium 30 through any intermediate tubulars 25 through any additional medium 31 through internal tubular 24 and into the central passage 28 of internal tubular 24. Artificial lift system 10 may be generally circular in cross section and sized to fit within the production casing of a well [not shown]. In some embodiments, pump 100 may be an ESP that receives electrical power from the surface via an electrical cable within the well bore [not shown].

Filter assembly 116 comprises top plate 18 and bottom plate 20. Top plate 18 allows internal tubular 24 to pass through its center portion and may be joined to inlet connector 14 in a fluid tight manner. Top plate 18 and bottom plate 20 are connected by an external tubular 22 and by an internal tubular 24. The external tubular 22 may be a screen or other type of porous structure that allows a desired wellbore fluid to pass from one side of the tubular to the other while restraining the passage of undesired wellbore fluids or solids. The internal tubular 24 may be a screen or other type of porous structure that allows a desired wellbore fluid to pass from one side of the tubular to the other while restraining the passage of undesired wellbore fluids or solids. Additionally, shown in FIG. 3, there may be one or more intermediate tubulars 25 that may also comprise a screen or other type of porous structure that allows a desired wellbore fluid to pass from one side of the tubular to the other while restraining the passage of undesired wellbore fluids or solids. Together, external tubular 22, intermediate tubular 25, and internal tubular 24 define at least two annular spaces 32 and 33 that may be used to contain at least two media 30 and 31 [partially shown for clarity]. Additionally, while not shown, should at least two intermediate tubulars 25 be used, any number of annular spaces may be created between external tubular 22 and internal tubular 24. The additional annular spaces may be used to contain a plurality of differentiated media.

Should the filter assembly 116 (including any intermediate tubulars or media contained in the additional annular spaces created by the intermediate tubulars) become at least partially clogged with solid or other matter that may be present in the wellbore such that wellbore fluid can no longer pass through the filter assembly 116 and reach the artificial lift system 10, the artificial lift system 10 may be severely damaged. Such damage may result from pump cavitation. In cases where the wellbore fluid is used to cool the artificial lift system's motor a partially clogged filter assembly may reduce the flow of cooling wellbore fluid to the point where motor overheating may also occur. In order to prevent such damage to the pump, motor or drive system a by-pass valve 134 may be installed. Typically, although not always, in the bottom plate 20. The by-pass valve 134 may be a ball valve, a spring-loaded valve, a poppet valve, a shear assembly, or any other type of valve that may be activated if a sufficient differential pressure is determined to exist. When the pressure drop across the screen equals the by-pass setting, the by-pass valve 134 partially opens and wellbore fluid is allowed to by-pass the filter assembly 116. As fluid by-passes the filter assembly 116, the flow rate through the filter is reduced; thus, the pressure drop is reduced for the sand-packed filter. With the by-pass valve 134 partially open, a portion of the wellbore fluid is flowing into the central passage 28 through the filter assembly and a portion is flowing into the central passage 28 through the by-pass valve 134. The proportions of wellbore fluid that are passing through the filter assembly 116 and the by-pass valve 134 can be represented by Q (total flow)=Qf (flow through filter assembly)+Qb (by-pass flow). As time passes, Qf will be reduced as more wellbore matter packs into the filter assembly 116 and the P (pressure) drop increases for a given flow rate thus causing Qb to increase. A typical flow curve is illustrated in FIG. 2. As the pressure drop across the filter assembly 116 increases, a larger fraction of the total flow passes through the by-pass valve 134. Those skilled in the art will appreciate that different bypass valve designs will exhibit different flow curves. In an alternative embodiment where a by-pass valve 134 is provided, the by-pass valve 134 could be opened just prior to the point at which wellbore fluid flow is reduced to the level that is predicted to damage the artificial lift system. In addition, activation of the bypass valve could alert the operator on the surface that the filter assembly 116 might require service. Such service may comprise removal of the entire artificial lift system and filter assembly, reverse operation of the artificial lift system, or back-flushing fluid through the system from the surface so as to force out matter that may have accumulated in the filter assembly.

External tubular 22 may be any porous material, including metals, composites or plastics with sufficient corrosion resistance and structural strength to withstand the torque, well obstructions, tension loading, compression loading, pressure differentials or any other conditions that may be encountered during insertion in the production casing and operation of the artificial lift system. In certain embodiments, external tubular 22 may be a wire mesh screen. In other embodiments, external tubular 22 may be a wire-wound screen. Stainless steels are a particularly preferred screen material owing to their mechanical strength and corrosion resistance. The screen may comprise a mechanical support for providing structural integrity. The screen may be selected to provide the desired opening size to exclude the sand and/or fines encountered in a particular well environment.

The at least one intermediate tubulars 25 and internal tubular 24 may also be a screen or, in other embodiments, may comprise a pipe having openings or perforations 26. Openings 26 may also be size-selected for a particular application. Openings 26 may comprise holes or slots in the wall of internal tubular 24. Internal tubular 24 defines at least one central passage 28 that is in fluid communication with inlet connector 14 of pump 100.

The at least two annular spaces 32 and 33 may be occupied by the at least two media 30 and 31 which may be a porous medium such as pumice—a highly-porous igneous rock, usually containing 67 to 75% $SiO_2$ and 10 to 20% $Al_2O_3$. Potassium, sodium and calcium are generally present. Pumice has a glassy texture. It is insoluble in water and not attacked by acids. It is commercially available in lump or powdered form (coarse, medium and fine).

Media 30 and 31, when impregnated with a chemical agent, may be used to perform at least two functions: 1) mechanical filtration; and, 2) treatment of the fluid(s) flowing into the inlet of pump 100 with the chemical agent. The mechanical filtration function excludes sand and fines that are not blocked by external tubular 22. The extent of this mechanical filtration is determined, at least in part, by the particle size and packing density of the media 30 and 31. Accordingly, the composition of media 30 and 31, its particle size and its loading within the annular spaces 32 and 33 may be optimized for various well conditions.

The size and configuration of the openings in the intermediate tubulars 25 and in internal tubular 24 may be optimally chosen to exclude the media 30 and 31 while providing the minimum restriction to flow of the production fluids.

Top plate 18 and/or bottom plate 20 may be removable to facilitate charging filter assembly with at least media 30 and 31.

In some embodiments, media 30 and 31 may be chemical agents in a solid form that slowly dissolves in the production fluids. In such embodiments, the physical filtering function of the media 30 and 31 dissipates over time and hence external tubular 22 and internal tubular 24 should be selected to provide sufficient sand and/or fines exclusion to adequately protect pump 100.

Figure 5:
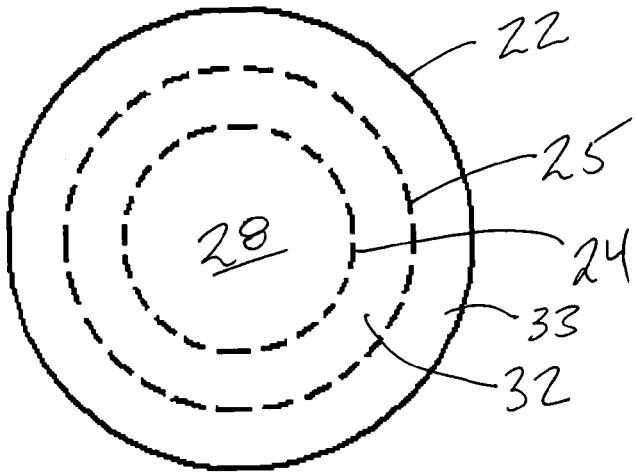
FIG. 5 is a cross-sectional view of the intake screen portion of the apparatus shown in FIG. 4 taken along line V—V.

FIG. 5 is a cross-sectional view of filter assembly 116 taken perpendicular to its major axis. Screen 22, at least one intermediate wall 25 and central conduit 24 can be seen to define at least two annular spaces 32 and 33. In use, central passage 28 is in fluid communication with the inlet of pump 100 via inlet connector 14.

Figure 4:
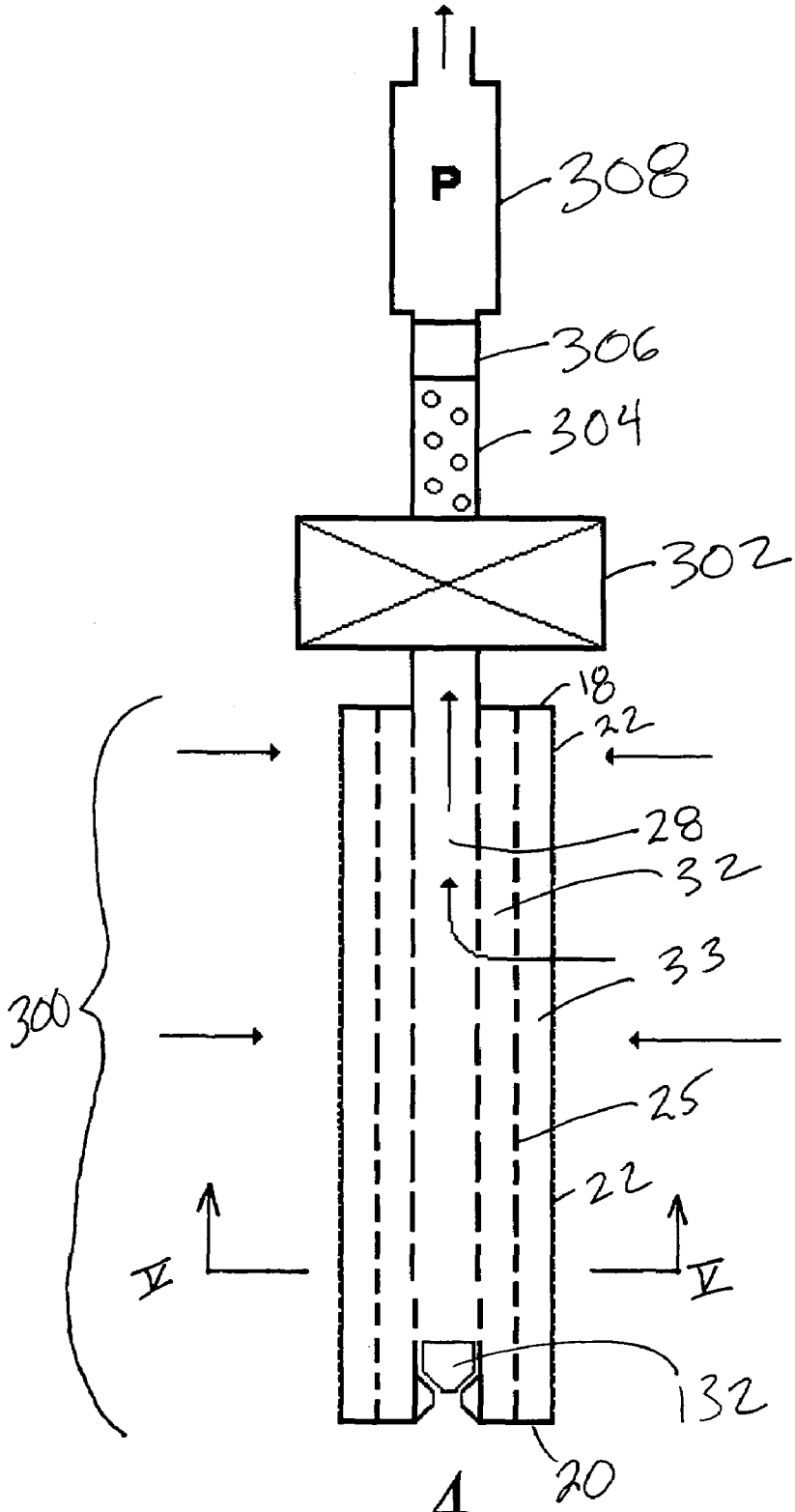
FIG. 4 depicts the apparatus of FIG. 3 additionally equipped with a packer, shear sub and cross-over sub.

Additional downhole components may be included in order to facilitate the use and recovery of the apparatus. The embodiment of the invention shown in FIG. 4 includes filter assembly 300, packer 302, crossover subassembly 304, shear sub 306, and artificial lift system 308. The shear subassembly 304 is intended to allow the artificial lift system 308 to be removed without removing the packer 302, crossover subassembly 304, and the filter assembly 300 in those instances when the packer 302 is unable to be removed from the wellbore due to sand accumulations or any other cause. The conditions where the packer 302, crossover subassembly 304, and filter assembly 300 may become stuck in the wellbore usually occur at the end of the filter assembly 300's life cycle when the bypass valve 132 has opened and sand is passing through the assembly. Some of this sand may settle on top of the packer making it difficult to remove from the well. In such cases, the artificial lift system 308 may be separated from the sheer sub 306 and removed from the wellbore. The packer 302 may then be milled out of the bore and any remaining equipment fished from the well.

One preferred scale inhibitor is phosphoric acid (also known as orthophosphoric acid), a colorless, odorless liquid or transparent, crystalline solid, depending on concentration and temperature. The pure acid (100% strength) is in the form of crystals that melt at about 42° C. and lose ½ mole of water at 213° C. to form pyrophosphoric acid.

The scale inhibitor may be a phosphate salt—a group of salts formed by neutralization of phosphorous or phosphoric acid with a base, such as NaOH or KOH. Orthophosphates are phosphoric acid ($H_3PO_4$) salts, where 1, 2 or 3 of the hydrogen ions are neutralized. Neutralization with NaOH gives three sodium orthophosphates: (a) monosodium phosphate (MSP), (b) disodium phosphate (DSP) or (c) trisodium phosphate (TSP). Their solutions are buffers in the 4.6 to 12 pH range. All will precipitate hardness ions such as calcium.

By utilizing this method the wellbore fluid may be treated downhole with other chemicals as well including inhibitors such as corrosion inhibitors, emulsion breakers, surfactants, chemicals to prevent the deposition of paraffin, hydrogen sulfide scavengers.

It will be appreciated by those skilled in the art that each chemical agent in media 30 and/or 31 will become depleted in use as production fluids flow over media 30 and/or 31 dissolving or desorbing the chemical agent. If the chemical agent is a liquid at the temperatures and pressures existing in the downhole environment, filter assembly 116 may be equipped with a capillary tube recharge means as illustrated in FIG. 6.

Figure 6:
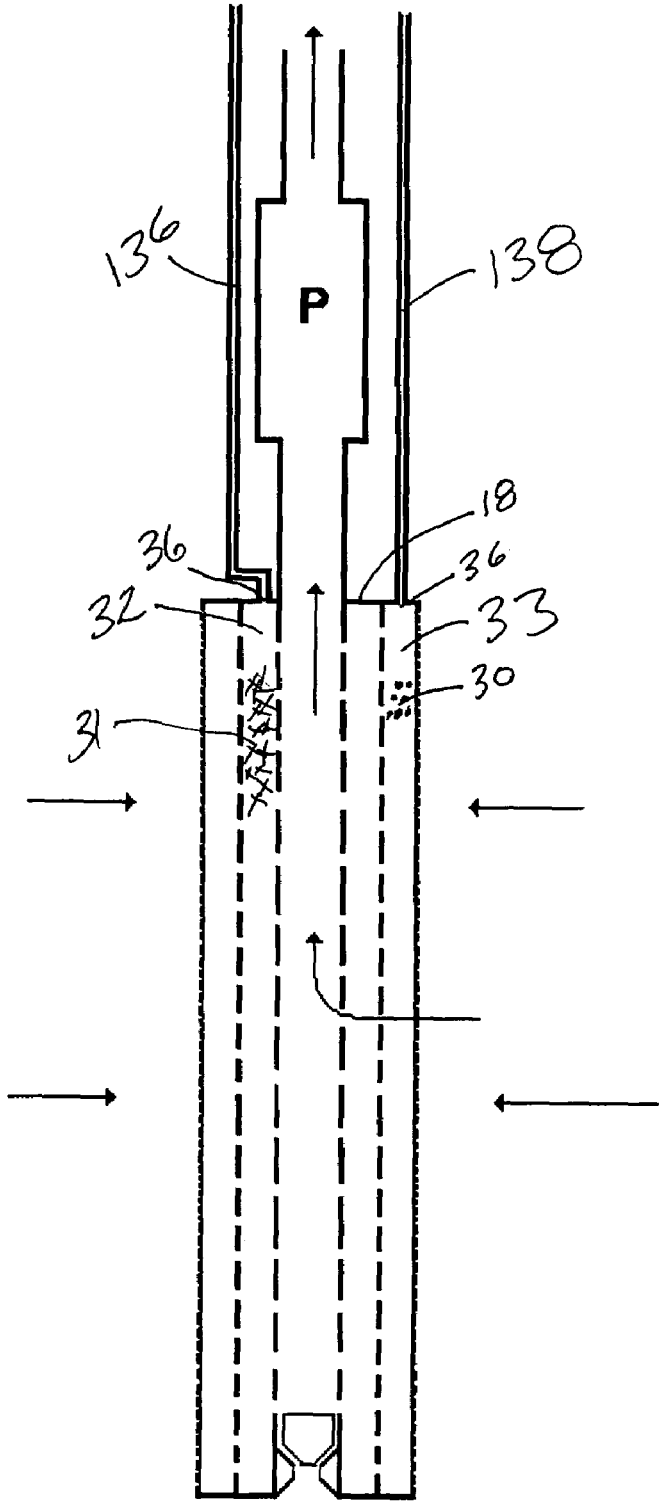
FIG. 6 is a cross-sectional view of an artificial lift pump equipped with a multiple layer intake screen having capillary tube recharge means.
Figure 7:
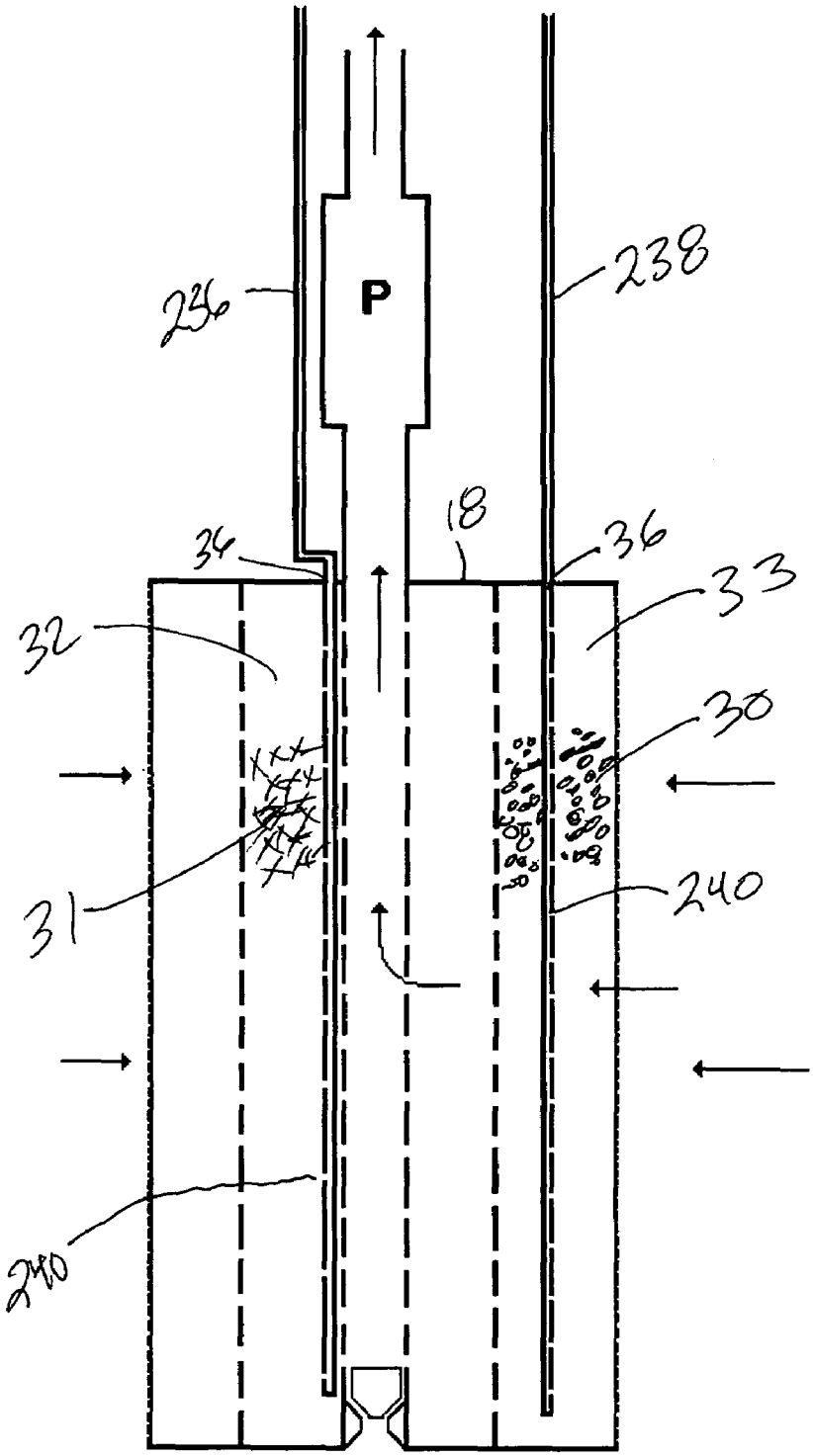
FIG. 7 is an alternative embodiment of the apparatus shown in FIG. 6 which includes means for distributed recharge of the treatment chemicals.

FIG. 6 depicts the multi-layer embodiment of FIG. 3 with the addition of capillary tubes 136 and 138 that are in fluid communication with annular spaces 32 and 33, respectively, via openings 36 in top plate 18. When the concentration of chemical agents in the production fluid(s) falls to an ineffective level, porous media 30 and/or 31 may be recharged by providing chemical agents into annular spaces 32 and 33 via capillary tubes 136 and/or 138 from the surface. The chemical agent may be moved through the capillary tubes 136 and/or 138, by gravity, pumping from the surface, pumping from downhole, gas pressure, pumping from a reservoir or any other method of moving a gas, liquid, fine solid, or solid in liquid suspension through a relatively long tube. Once the chemical agent is brought into contact with the medium the chemical agent is absorbed into porous medium 30 (and/or 31), recharging it. In an alternative embodiment shown in FIG. 7, the capillary tubes 236 and 238 pass through openings 36 in the top plate 18 so as to disperse the recharging chemicals along the length of the annuli 32 and 33 through perforations 240 in the capillary tubes 236 and 238.

Figure 12A:
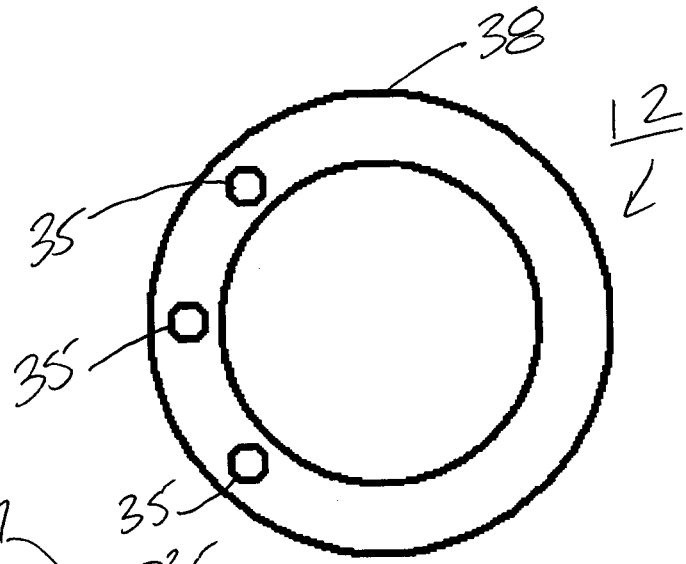
FIGS. 12A and 12B are cross-sectional views of production tubing having capillary tubing incorporated within their wall structure.
Figure 12B:
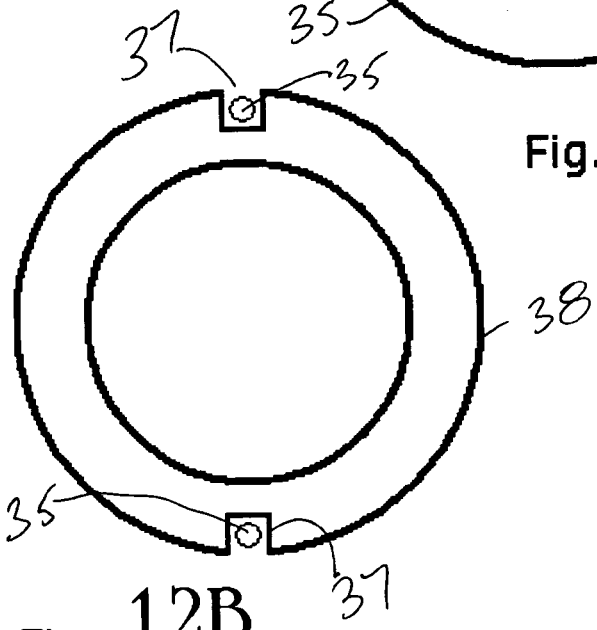

As shown in the transverse, cross-sectional view of FIG. 12A, capillary tube(s) 35 may be formed in wall 38 of production tubing 12. Alternatively, as illustrated in FIG. 12B, capillary tubes may be contained within notches 37 in wall 38 of production tubing 12. Bands or straps [not shown] at intervals along the production tubing may be used to retain capillary tube(s) within notches 37. Chemical agent that may be in liquid, gas, or solid powder form or combinations thereof, may be introduced into filter assembly 116 by means of wall capillary tube 35, thereby avoiding the addition of separate capillary tubes such as 136 and 138 to the apparatus, which may be more susceptible to mechanical damage within the well bore. The chemical agent employed may be the reaction product of two or more reactants. If, for example, the chemical agent were hazardous to handle, it could be produced in situ by introducing the reactants that form the agent by means of separate wall capillary tubes 35. Similarly, binary or ternary chemical agents could be created in situ with the relative amount of each component selected depending on operating conditions. Additionally, if the chemical agent is heat activated, the line carrying the specific chemical could be routed through cooling passages in the artificial lift system [not shown] where the excess heat from the artificial lift system could heat the chemical to at least the desired temperature. Thus, the chemical could be heated while serving as a coolant for the artificial lift system.

Figure 8:
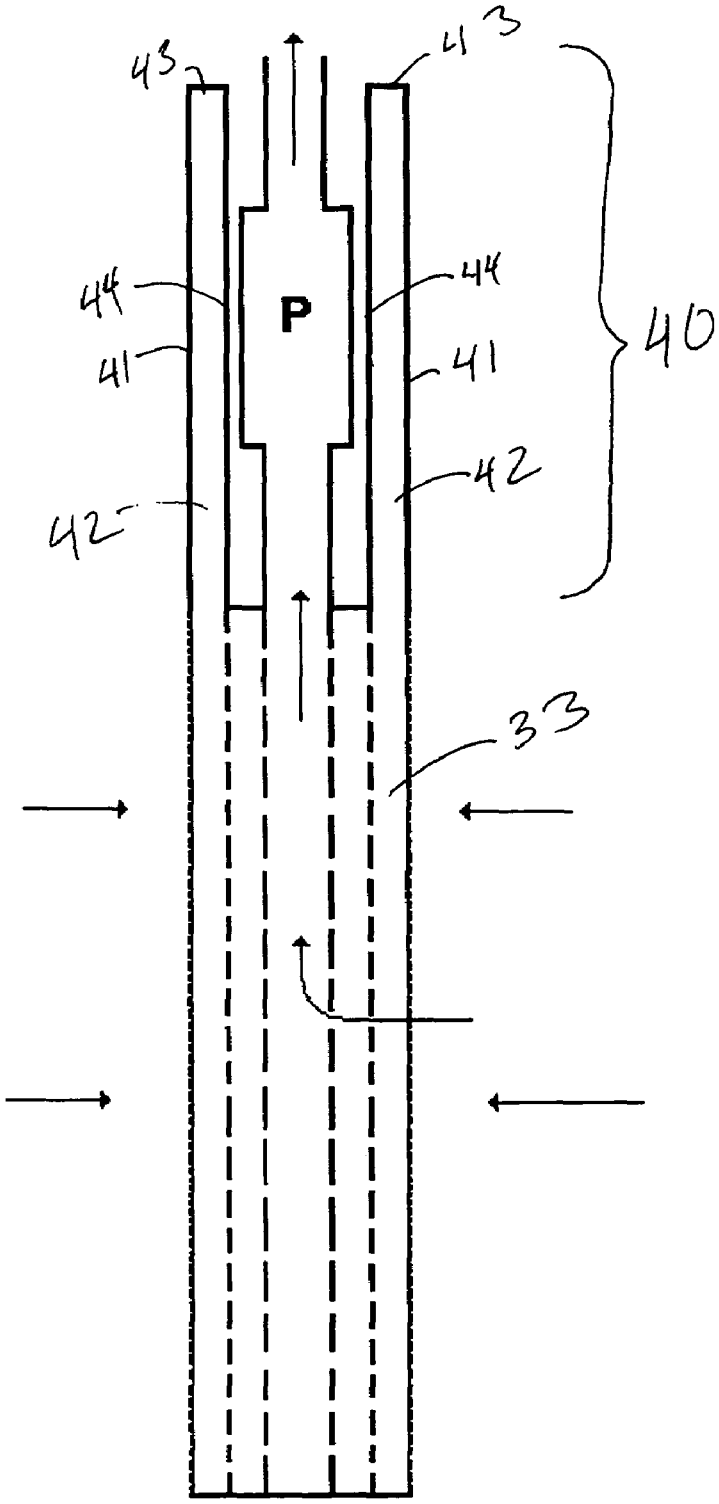
FIG. 8 is a cross-sectional view of an artificial lift pump equipped with a dual-layer intake screen equipped with a downhole replenishment means for solid-phase chemicals.

If the chemical agent is a solid-phase material that dissolves in the production fluid(s), downhole replenishment of the chemical agent supply may be accomplished with the apparatus shown in longitudinal cross section in FIG. 8. In the particular embodiment illustrated, the dual-layer filter assembly of FIG. 3 is modified by the addition of extension 40 comprising outer wall 41, intermediate wall 44 and top plate 43. Outer wall 41, intermediate wall 44, top plate 43, and the inner wall may be impervious to production fluids and assembled in a fluid tight manner. Annular space 42 of extension 40 defined by outer wall 41, inner wall 44, top plate 43 and the inner wall is an extensions of annular space 33. Annular space 42 may therefore function as a supply hopper for the chemical agent exposed to the production fluids in annular space 33 of filter assembly 116. As the solid phase chemical agent is dissolved from annular space 33, fresh chemical agent from annular space 42 will fall into annular spaces 33 under the influence of gravity.

Figure 9:
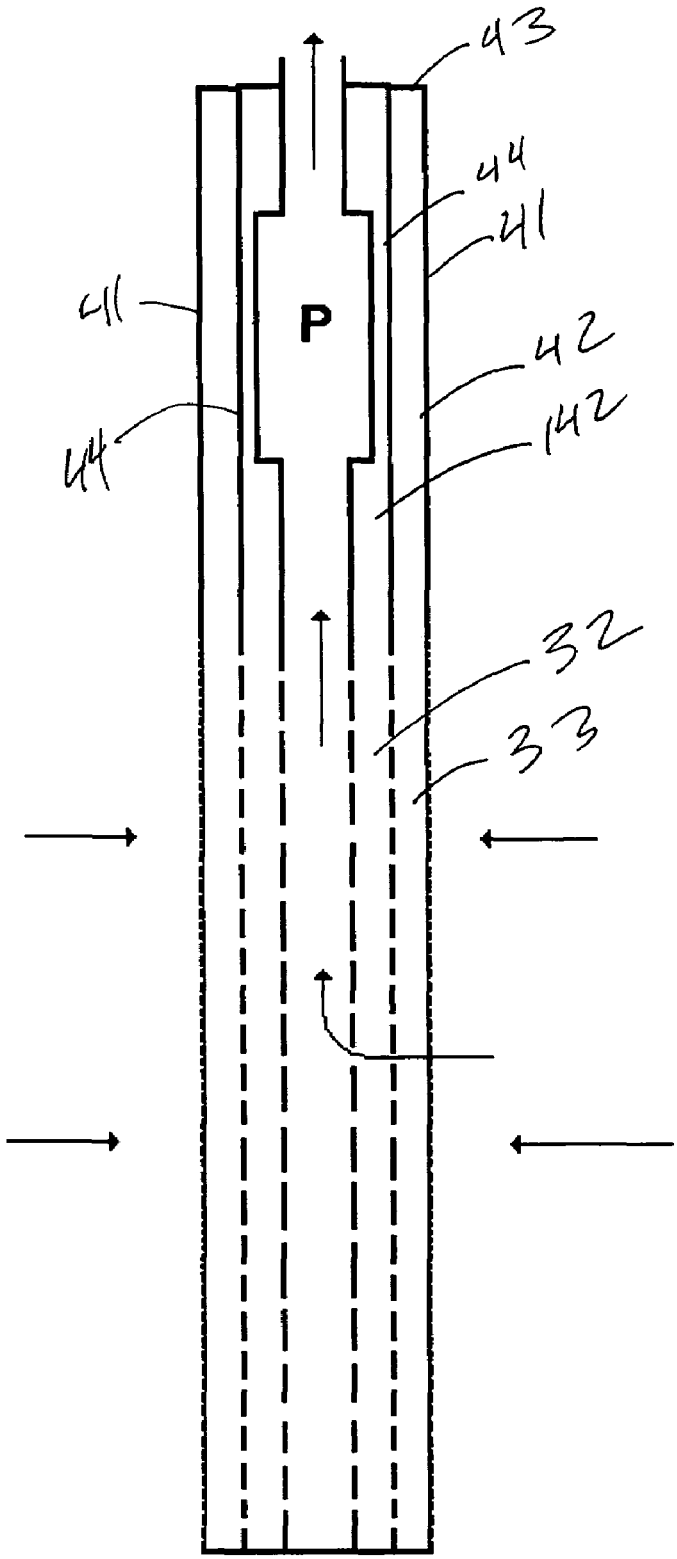
FIG. 9 is an alternative embodiment of the apparatus shown in FIG. 8 which has means downhole replenishment of both solid-phase and liquid-phase chemicals.

FIG. 9 illustrates an alternative embodiment having separate annular hoppers for replenishing the chemical agents in annular spaces 32 and 33. Inner tubular 14, the artificial lift system housing 100, and the production tubular 12 form an inner wall. Outer wall 41, intermediate wall 44, top plate 43, and the inner wall may be impervious to production fluids and assembled in a fluid tight manner. Annular spaces 42 and 142 of extension 40 defined by outer wall 41, inner wall 44, top plate 43 and the inner wall are extensions of annular spaces 32 and 33. Annular spaces 42 and 142 may therefore function as supply hoppers for each chemical agent exposed to the production fluids in annular spaces 32 or 33 of filter assembly 116. As the solid phase chemical agent is dissolved from annular spaces 32 and 33, fresh chemical agent from annular space 42 and 142 will fall into annular spaces 32 and 33 under the influence of gravity. Such an apparatus may employ chemical agents having different phases. For example hopper 142 may contain a liquid agent while hopper 42 contains a solid chemical treatment agent.

In this way, the useful life of the filter assembly with the treating chemicals may be extended. Since oil and gas wells may be thousands of feet deep, there is typically ample volume in the annular space between the production casing and the production tubing to accommodate an extension 40 of significant capacity. The length of extension 40 is limited only by the availability of annular space between the production tubing and the casing. In alternative embodiments the extension 40 or even a separate hopper assembly [not shown] could be refilled by using a capillary or feed tube system. In another embodiment the extension 40 could be attached to the filter assembly as a separate hopper that could be refilled by retrieving the hopper. One means for retrieving the hopper could be by using a wireline.

Figure 10:
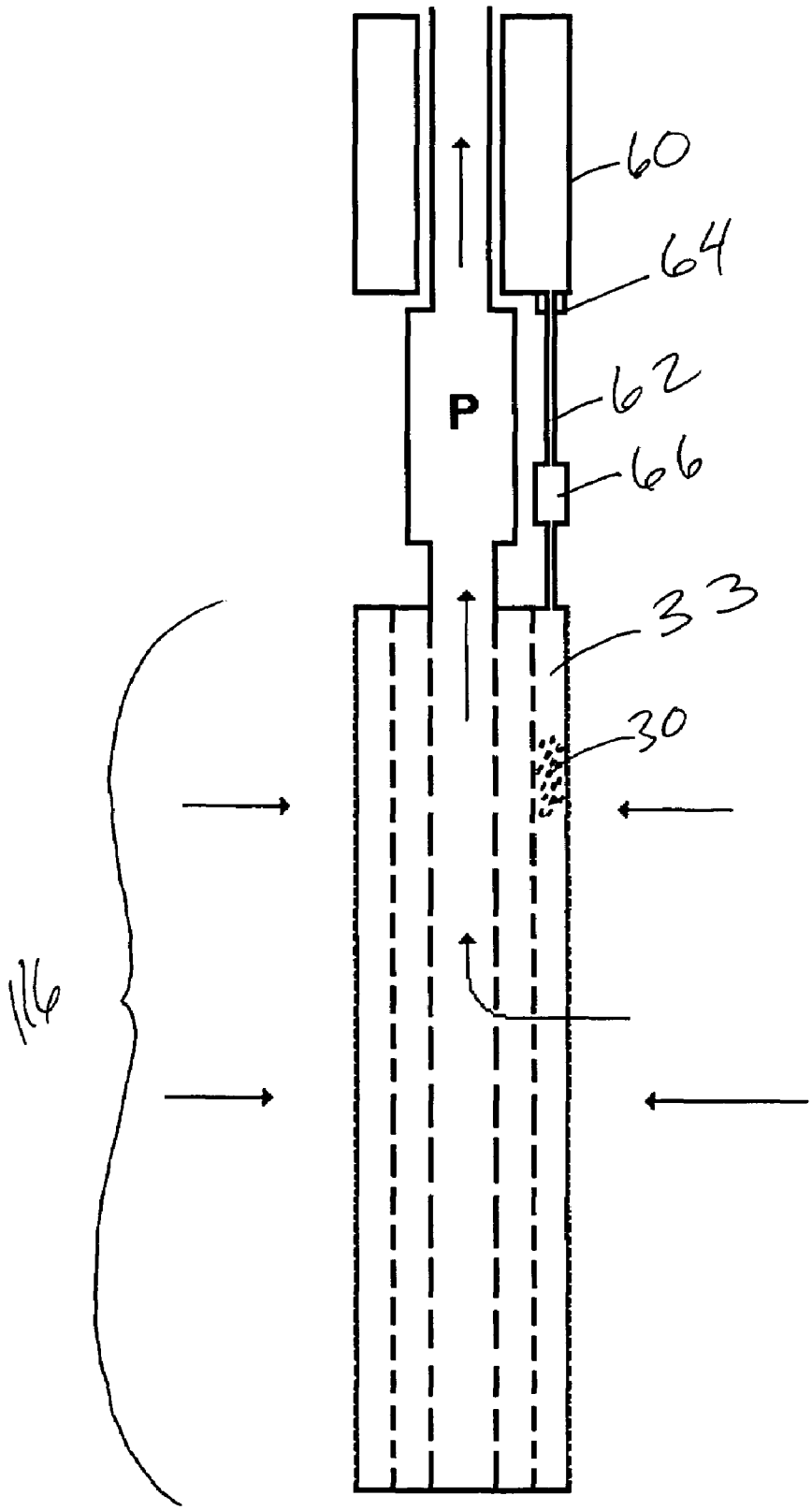
FIG. 10 is a cross-sectional view of an artificial lift pump that has a dual-layer intake screen equipped with a downhole replenishment means for liquid-phase chemicals.

If the chemical agent is a liquid-phase material, a downhole reservoir of the agent may be provided and utilized by means of the apparatus shown in longitudinal cross section in FIG. 10. While a single-layer filter may be utilized, in the particular embodiment illustrated, filter assembly 116 is the at least dual-layer type shown in FIG. 3. Chemical agent reservoir 60 is adapted to be located in the annular space between the production tubing and the production casing. Reservoir 60 may be connected to supply conduit 62 via coupling 64. Coupling 64 may be a quick-connect type of coupling that permits reservoir 60 to be wireline retrievable for refilling at the surface. Supply conduit 62 provides a fluid connection between reservoir 60 and annular space 33 of filter assembly 116 via valve or metering means 66. The flow of liquid phase chemical agent from reservoir 60 to the filter assembly 16 may be regulated by time and/or volume by valve/metering means 66. Valve 66 could be adjusted by sending a signal down the ESP cable or with an I-wire. Valve 66 may also comprise a metering pump which may, in certain embodiments, be electrically or hydraulically powered. The pump discharge pressure could also be utilized to adjust the valve or operate the hydraulic metering pump. When the pump is turned off the drop in discharge pressure could shut the valve and stop the flow of chemicals. Within annular space 33, a distribution means may be provided for distributing the chemical agent in a desired pattern throughout the medium 30. The distribution means may be a fluid conduit having a plurality of orifices sized to provide a desired delivery rate of the chemical agent to medium 30. Reservoir 60 may be pressurized by a compressed gas in the head space above the chemical agent. Alternatively, the chemical agent may be contained within an elastomeric bladder contained within reservoir 60 and the surrounding space pressurized to provide a supply of chemical agent under pressure. In yet other embodiments, reservoir 60 may be provided with pressure equalization means to permit gravity flow of chemical agent from reservoir 60 to annular space 33.

Figure 11:
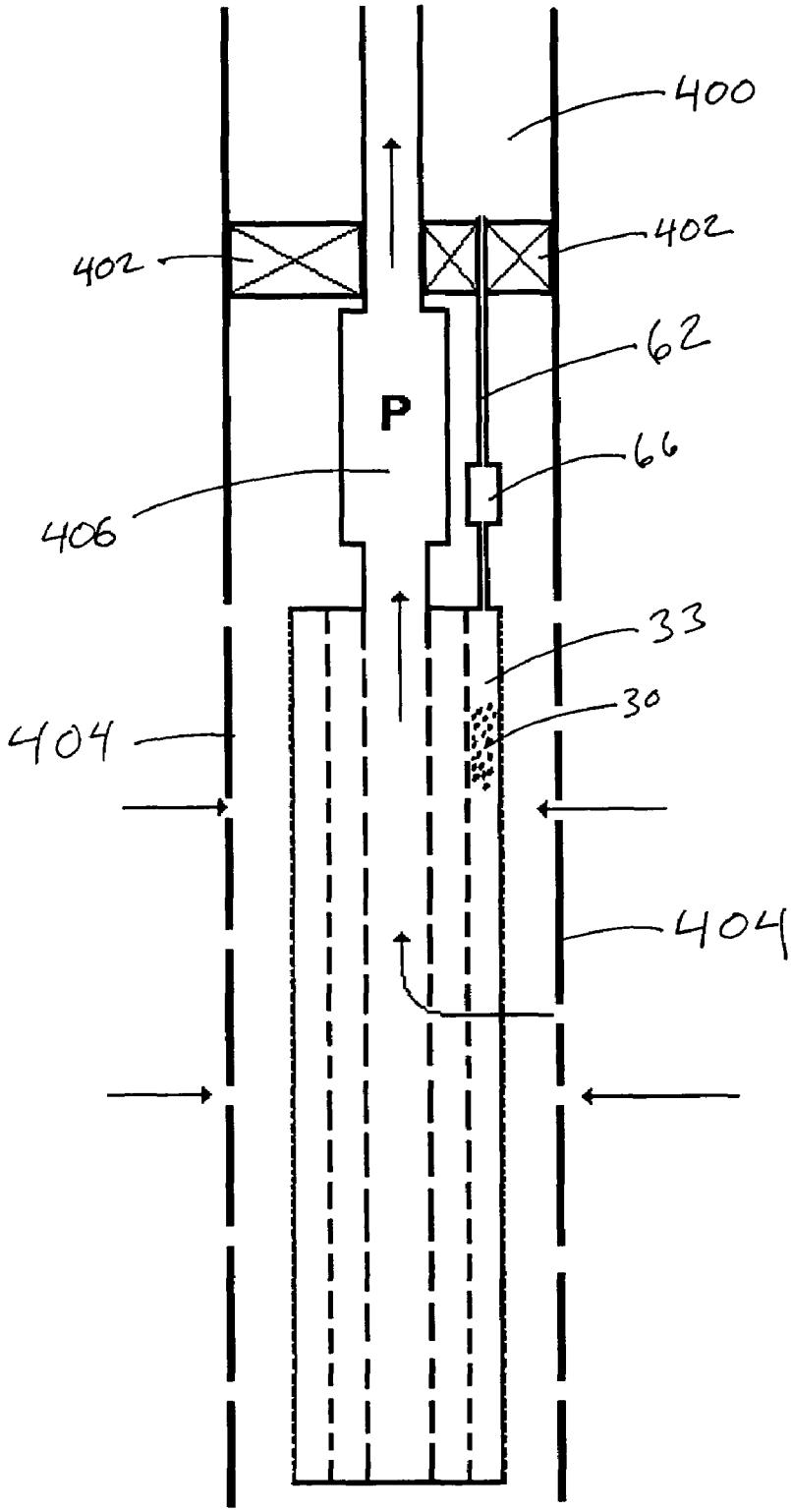
FIG. 11 is a cross-sectional view of an alternative embodiment of the apparatus shown in FIG. 10.

FIG. 11 depicts one alternative embodiment of the invention illustrated in FIG. 10 wherein annular space 400 within well casing 404 above packer 402 replaces reservoir 60. In certain embodiments, packer 402 may be a cup packer. A chemical treatment agent (which may be a liquid-phase substance) may be inserted into annular space 400 before, during or after installation of artificial lift pump 406.

Figure 13:
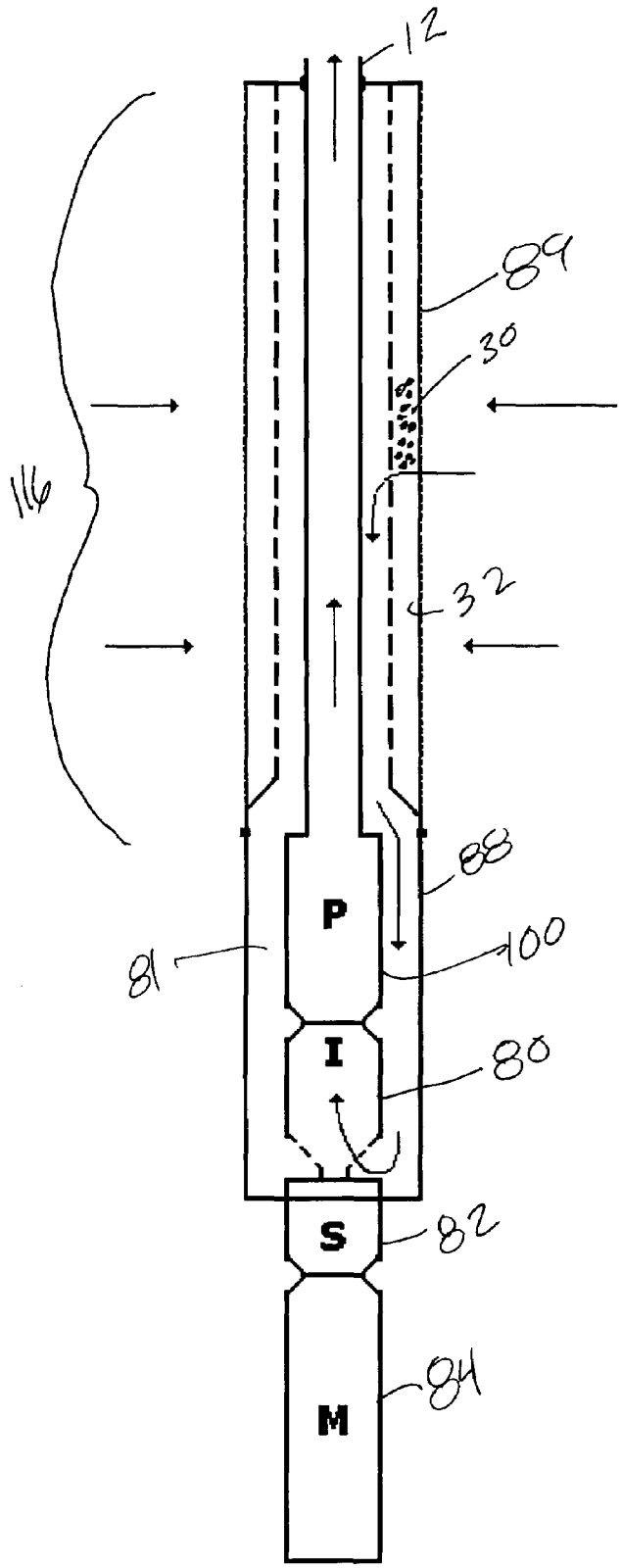
FIG. 13 is a cross-sectional view of an artificial lift pump equipped with a wireline (or slickline) retrievable, chemical treatment intake screen.

FIG. 13 depicts an embodiment of the invention wherein filter assembly 116 is positioned above pump 100. This configuration permits filter assembly 116 to be wireline retrievable from the surface for maintenance and/or recharging of chemical agent without necessarily removing the artificial lift system. In the particular embodiment illustrated, pump 100 is shaft-driven from motor 84 through motor seal 82 and concentric inlet 80. Filter assembly 16 comprises removable upper section 89 and lower section 88 that form a fluid-tight connection around motor seal 82. In alternative embodiments, lower section 88 may encompass motor 84 or may seal to motor 84. The arrows in FIG. 13 depict the direction of production fluid flow from the surrounding formation, into filter assembly 116 where sand and fines are mechanically filtered out and the fluid(s) are treated with chemical agent which dissolves or desorbs from medium 30 in annular space 32. The fluid then flows downward (under the influence of the pressure differential created by pump 100) through annular space 81 and into pump intake 80 where it enters pump 100 and is lifted to the surface via production tubing 12.

Figure 14:
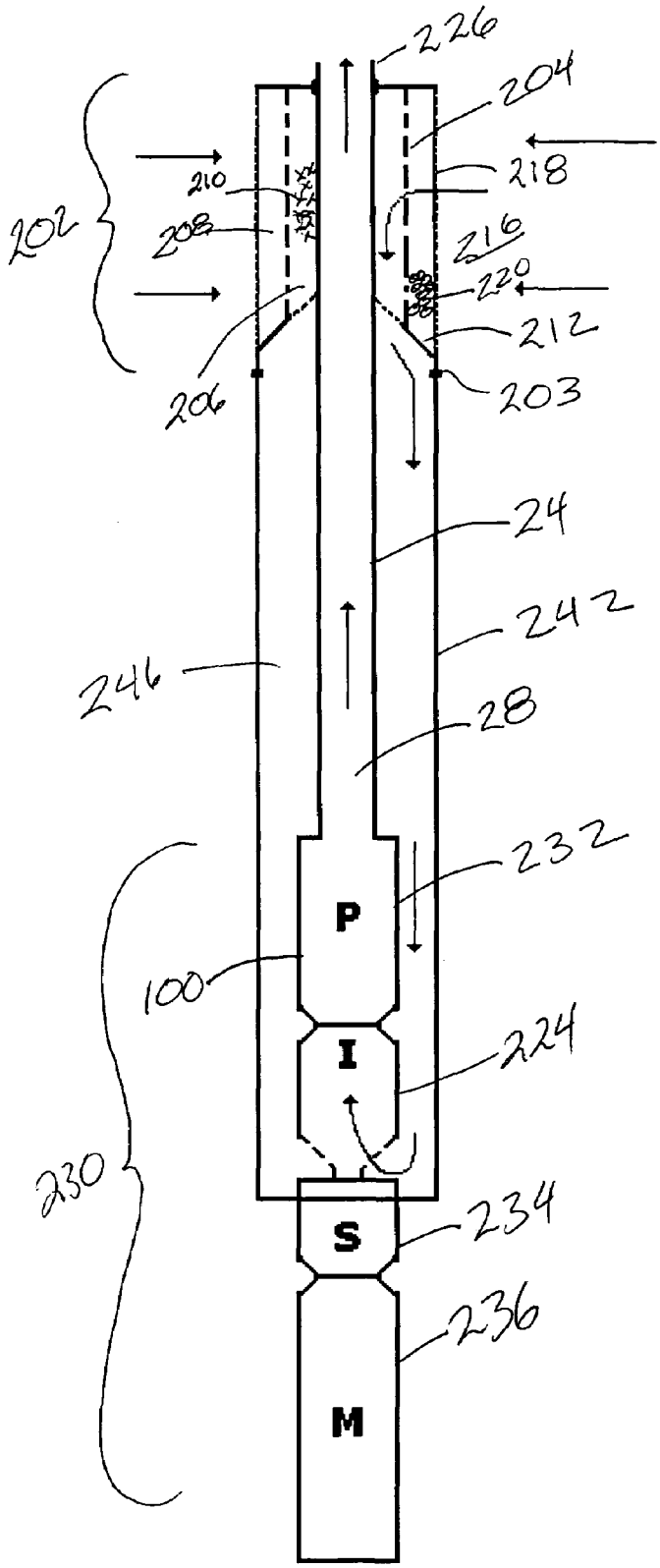
FIG. 14 is an alternative embodiment of the apparatus shown in FIG. 13 that further comprises an extension of the shroud around the pump and intake sections.

FIG. 14 depicts another embodiment of the invention wherein filter assembly 202 is positioned above pump 100. In the configuration depicted filter assembly 202 includes one or more intermediate tubulars 204 [only a single intermediate tubular is shown for clarity] and thus filter assembly 202 has at least two annular spaces, 206 and 208. It will be appreciated by those skilled in the art that multiple intermediate walls may be incorporated into filter assembly 202 and thus multiple annular spaces may be defined within the apparatus. Each annular space may be used to contain a different medium to provide various functions—e.g., graduated mechanical filtration and/or treatment with different chemical agents. Intermediate wall 204 may comprise a screen, perforated tubular, or other type of porous material. Filter bottom plate 212 is non-porous so as to force fluid that enters the outermost, as fluid flows into the filter assembly from the exterior, of multiple annular spaces 208 to enter into the innermost of any number of subsequent annular spaces 206. It is understood that any additional annular spaces between the outermost annular space 208 and innermost annular space 206 would most preferably have a non-porous bottom plate to force fluid into enter into any number of subsequent annular spaces. Filter assembly 202 is preferably designed such that wellbore fluid will pass from the exterior 216 of external tubular 218 through external tubular 218 through any medium 220 through any intermediate tubulars 204 through any additional medium 210 through artificial lift assembly intake 224 and into the central passage 28 of internal tubular 24. This configuration permits filter assembly 202 to be wireline retrievable from the surface for maintenance and/or recharging of chemical agent without necessarily removing the artificial lift system.

In some instances, gas that may be present in the wellbore fluid may damage the artificial lift system 230 by causing the pump to cavitate, run at excessive speed, or repeatedly load and unload the artificial lift system. The embodiment depicted in FIG. 14 also allows for gas/fluid separation before the fluid enters the artificial lift assembly 230 in well conditions where the wellbore fluid has a significant amount of gas present by shrouding the artificial lift system intake and forcing the wellbore fluid to reverse direction thus causing a low pressure condition above the pump where entrained gas will be removed from the fluid. By removing the gas above the pump, the gas will rise up and away from the artificial lift system intake 224. In the particular embodiment illustrated, pump 232 is shaft-driven from motor 236 through motor seal 234 and artificial lift system intake 224. Filter assembly 202 comprises removable upper section 240 and lower section 242 that form a fluid-tight connection around motor seal 234. Upper section 240 may be releasably joined to lower section 242 by connector 203. In alternative embodiments, lower section 242 may encompass motor 236, in which case the fluid flow may also provide cooling for the motor or may seal to motor 236. The arrows in FIG. 14 depict the direction of production fluid flow from the surrounding formation into filter assembly 202 where sand and fines are mechanically filtered out and the fluid(s) are treated with chemical agent which dissolves or desorbs from the at least one medium 220 in annular space 208. The fluid then flows downward under the influence of the pressure differential created by pump 232 through annular space 246 and into artificial lift system intake 224 where it enters pump 232 and is lifted to the surface via production tubing 226.

Figure 15:
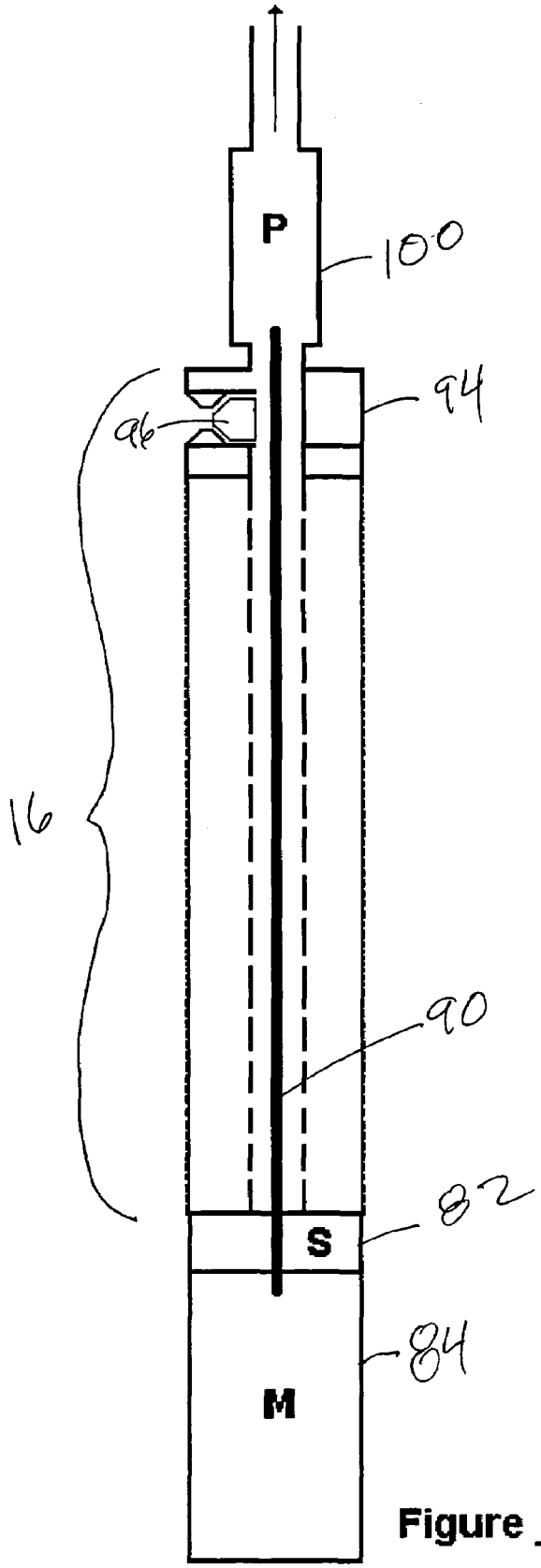
FIG. 15 is a cross-sectional view of a shaft-driven artificial lift pump equipped with a chemical treatment intake screen situated between the pump and its driving motor.

Yet another embodiment of the invention is shown in longitudinal cross section in FIG. 15. In this embodiment, filter assembly 16 is situated between pump 100 and pump motor 84. Pump 100 is driven by pump motor 84 by means of shaft 90, which may be exposed to the production fluids. The filter assembly 16 is connected to the motor seal 82. The embodiment illustrated in FIG. 15 may include a head unit 94 which contains at least one relief valve 96. The relief valve 96 may be configured to open at a pre-selected differential pressure to prevent pump 100 from cavitating or otherwise being damaged if filter 16 becomes blocked. The apparatus may also be equipped with signaling means for alerting operators that the bypass valves 96 have opened and the filter assembly should be retrieved and serviced.

Figure 16:
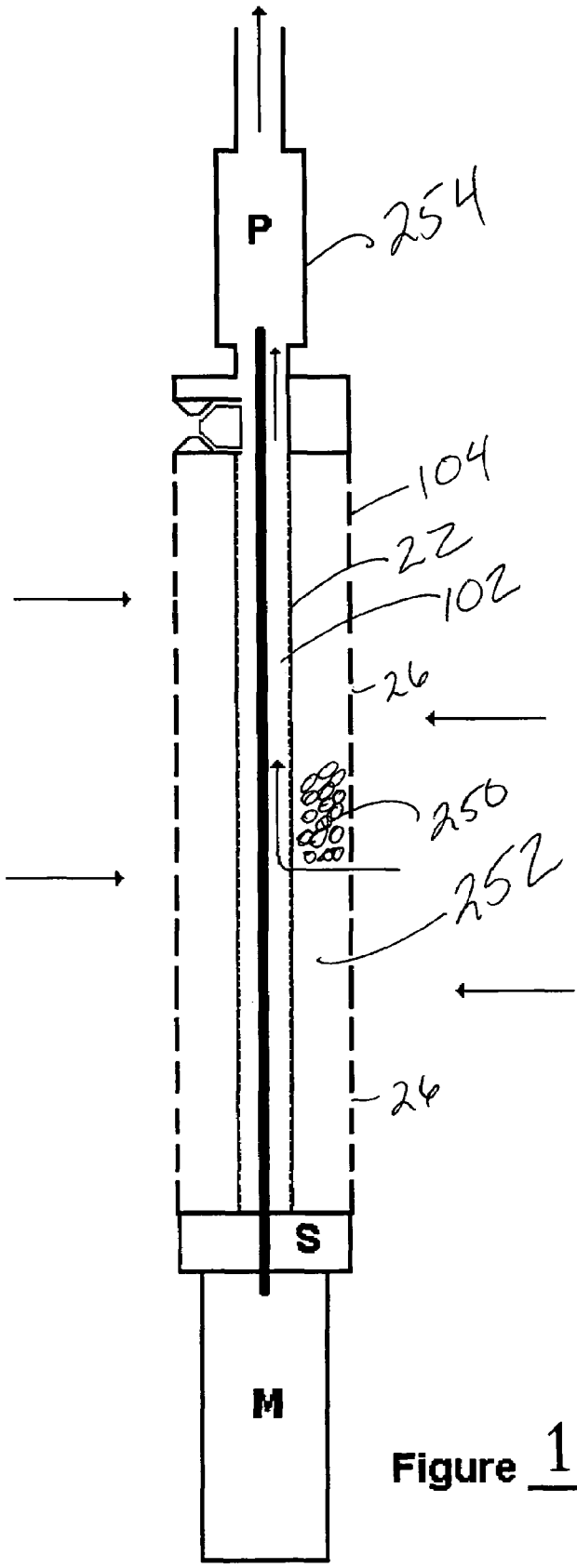
FIG. 16 is a cross-sectional view of an alternative embodiment of the apparatus of FIG. 15 wherein the screen is located within the interior portion of the intake filter.

FIG. 16 is an alternative to the embodiment shown in FIG. 15. In this embodiment, screen 22 is in the interior of the filter apparatus and forms the wall of central conduit 102. Outer wall 104 and screen 22 are in a spaced apart relationship so that at least one annulus 252 is created. At least one medium 250 resides in that at least one annulus 252 to allow for treatment of the wellbore fluid before the wellbore fluid enters into the artificial lift system 254. Outer wall 104 comprises openings 26 that may be relatively large compared to the effective openings in screen 22. In this embodiment, relatively more sand and fines may enter the filter assembly through openings 26 so that screen 22 is the final barrier to such contaminates prior to entry of the production fluid(s) into central conduit 102 and lift system 254.

While the present invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. An apparatus for the downhole chemical treatment of production fluids comprising:

a chamber having an interior space, at least two openings;

a porous medium within the interior space of the chamber; and, a production fluid treatment chemical in the porous medium which desorbs from the porous medium as production fluids flow through the porous medium.

2. An apparatus as recited in claim 1 wherein the porous medium is a mineral.

3. An apparatus as recited in claim 1 further comprising an artificial lift pump having an inlet and an outlet and with the inlet of the pump connected to an opening of the chamber.

4. An apparatus as recited in claim 3 wherein the artificial lift pump is an electric submersible pump.

5. An apparatus as recited in claim 1 wherein the production fluid treatment chemical comprises a scale inhibitor.

6. An apparatus as recited in claim 1 wherein the production fluid treatment chemical comprises phosphoric acid.

7. An apparatus as recited in claim 1 wherein the production fluid treatment chemical raises the pH of the production fluids.

8. An apparatus as recited in claim 1 wherein the production fluid treatment chemical lowers the pH of the production fluids.

9. An apparatus as recited in claim 1 wherein in the porous medium comprises pumice.

10. An apparatus as recited in claim 1 wherein at least one of the openings is a screen.

11. An apparatus as recited in claim 10 wherein the screen is a wire-wound screen.

12. An apparatus as recited in claim 10 wherein the screen is a sintered screen.

13. An apparatus as recited in claim 1 wherein the chamber is substantially cylindrical and comprises a removable top plate.

14. An apparatus as recited in claim 1 wherein the chamber is substantially cylindrical and comprises a removable bottom plate.

15. An apparatus as recited in claim 1 further comprising a tube in fluid communication with at least one opening and a packer surrounding the tube.

16. An apparatus as recited in claim 15 wherein the packer is a cup packer.

17. An apparatus as recited in claim 15 wherein the tube comprises a shear sub.

18. An apparatus as recited in claim 15 wherein the tube comprises a cross-over sub.

19. An apparatus as recited in claim 1 further comprising a capillary tube in fluid communication with the interior space.

20. An apparatus as recited in claim 1 further comprising a tube in fluid communication with at least one opening, the tube having a wall with a notch therein, and a capillary tube in fluid communication with the interior space, the capillary tube constrained within the notch for at least a portion of its length.

21. An apparatus as recited in claim 1 further comprising a tube in fluid communication with at least one opening, the tube having a double wall with an annular space between the walls, and a capillary tube in fluid communication with the interior space, the capillary tube traversing the annular space for at least a portion of its length.

22. An apparatus as recited in claim 21 further comprising a perforated tube within the interior space adjacent the porous medium, the perforated tube in fluid communication with the capillary tube.

23. An apparatus as recited in claim 21 further comprising a branched tube within the interior space in fluid communication with the capillary tube and having a plurality of openings adjacent the porous medium.

24. An apparatus for the downhole chemical treatment of production fluids comprising:

a chamber having at least two interior spaces and at least two openings;

wherein one of the interior spaces is an innermost interior space;

a porous medium within at least one of the at least two interior spaces of the chamber; and, a production fluid treatment chemical in the porous medium which desorbs from the porous medium as production fluids flow through the porous medium.

25. An apparatus as recited in claim 24 farther comprising an artificial lift pump having an inlet and an outlet and with the inlet of the pump connected to an opening of the innermost interior space of the chamber.

26. An apparatus as recited in claim 25 wherein the artificial lift pump is an electric submersible pump.

27. An apparatus as recited in claim 24 wherein the production fluid treatment chemical comprises a scale inhibitor.

28. An apparatus as recited in claim 24 wherein the production fluid treatment chemical comprises phosphoric acid.

29. An apparatus as recited in claim 24 wherein the production fluid treatment chemical raises the pH of the production fluids.

30. An apparatus as recited in claim 24 wherein the production fluid treatment chemical lowers the pH of the production fluids.

31. An apparatus as recited in claim 24 wherein in the porous medium comprises pumice.

32. An apparatus as recited in claim 24 further comprising a tube in fluid communication with at least one opening and a packer surrounding the tube.

33. An apparatus as recited in claim 32 wherein the packer is a cup packer.

34. An apparatus as recited in claim 32 wherein the tube comprises a shear sub.

35. An apparatus as recited in claim 32 wherein the tube comprises a cross-over sub.

36. An apparatus as recited in claim 24 further comprising a capillary tube in fluid communication with at least one interior space.

37. An apparatus as recited in claim 24 further comprising a first capillary tube in fluid communication with at least one interior space and a second capillary tube in fluid communication with another interior space.

38. An apparatus for the downhole chemical treatment of production fluids comprising:

a chamber having at least one interior space and at least two openings;

a porous medium within at least one of the interior spaces of the chamber;

a relief valve in fluid communication with an innermost of the at least one interior spaces of the chamber;

wherein the relief valve opens at a predetermined pressure differential; and, a production fluid treatment chemical in the porous medium which desorbs from the porous medium as production fluids flow through the porous medium.

39. An apparatus as recited in claim 38 wherein the first opening is a screen.

40. An apparatus as recited in claim 39 wherein the screen is a wire-wound screen.

41. An apparatus as recited in claim 38 wherein the screen is a sintered screen.

42. An apparatus as recited in claim 38 wherein the relief valve opens at a predetermined pressure differential between the first opening and the second opening.

43. An apparatus for the downhole chemical treatment of production fluids comprising:

a first chamber having an interior space, a first opening and a second opening; and a production fluid treatment chemical in the interior space which chemical is at least partially soluble in at least one of the production fluids.

44. An apparatus as recited in claim 43 wherein the production fluid treatment chemical comprises phosphoric acid.

45. An apparatus as recited in claim 43 further comprising a second chamber in fluid communication with the first opening for holding filter media.

46. An apparatus as recited in claim 43 wherein the first opening comprises a screen.

47. An apparatus as recited in claim 43 further comprising a relief valve in fluid communication with the second opening and which opens at a predetermined pressure differential between the first opening and the second opening.

48. A method for the downhole chemical treatment of well production fluids which comprises:

absorbing a production fluid treatment chemical into a porous medium; and, desorbing the production fluid treatment chemical from the porous medium by passing well production fluids across the porous medium.

49. A method as recited in claim 48 wherein the porous medium comprises pumice.

50. A method as recited in claim 48 wherein the production fluid treatment chemical comprises a scale inhibitor.

51. An apparatus for the downhole chemical treatment of well production fluids comprising:

a chamber having at least two, substantially cylindrical, concentric, interior spaces and at least two openings;

wherein one of the interior spaces is an innermost interior space;

a porous medium within at least one of the at least two interior spaces of the chamber;

a production fluid treatment chemical in the porous medium; and, a fluid-permeable screen separating at least two of the interior spaces.

52. An apparatus for the downhole chemical treatment of well production fluids comprising:

a chamber having at least two, substantially cylindrical, concentric, interior spaces and at least two openings;

wherein one of the interior spaces is an innermost interior space;

a porous medium within at least one of the at least two interior spaces of the chamber;

a production fluid treatment chemical in the porous medium which desorbs from the porous medium as production fluids flow through the porous medium; and, a fluid-permeable screen contiguous with at least one opening.

53. An apparatus for the downhole chemical treatment of production fluids comprising:

a chamber having at least two, substantially cylindrical, concentric, interior spaces and at least two openings;

wherein one of the interior spaces is an innermost interior space;

a porous medium within the at least two interior spaces of the chamber;

a first production fluid treatment chemical in the porous medium in at least one interior space; and, a second production fluid treatment chemical in the porous medium in another interior space.

54. An apparatus for the downhole chemical treatment of production fluids comprising:

a chamber having at least two, substantially cylindrical, concentric, interior spaces and at least two openings;

wherein one of the interior spaces is an innermost interior space;

a filter medium having a first porosity within the innermost interior space;

a filter medium having a second porosity within another interior space;

a porous medium within at least one interior space; and a production fluid treatment chemical in the porous medium which desorbs from the porous medium as production fluids flow through the porous medium.

55. A method for recharging a downhole chemical treatment apparatus having a porous medium for containing a chemical agent comprising:

pumping the chemical agent via a capillary tube into a downhole chamber containing the porous medium; and, contacting the porous medium with the chemical agent until at least a portion of the chemical agent is absorbed into the porous medium.

56. An apparatus for the downhole chemical treatment of production fluids comprising:

a chamber having an interior space and at least three openings;

a hopper connected to at least one of the three openings for supplying a solid-phase production fluid treatment chemical to the interior space of the chamber.

57. An apparatus as recited in claim 56 wherein the solid-phase production fluid treatment chemical is supplied under the influence of gravity from the hopper to the interior space as the treatment chemical dissolves in the production fluid.

58. An apparatus as recited in claim 56 wherein the hopper has an annular shape and is attached to an upper end of the chamber.

59. An apparatus as recited in claim 56 wherein the hopper comprises a removable top plate.

60. An apparatus as recited in claim 56 further comprising a pressure relief valve in fluid communication with the interior space.

61. An apparatus as recited in claim 56 further comprising an electric submersible pump in fluid communication with one of the at least three openings.

62. An apparatus as recited in claim 56 comprising a plurality of interior spaces within the chamber and a plurality of hoppers connected to the spaces.

63. An apparatus as recited in claim 62 wherein the hoppers are concentric and have a generally annular configuration.

64. An apparatus for the downhole chemical treatment of production fluids comprising:

a chamber having an interior space and at least three openings;

a porous medium within the interior space of the chamber;

a production fluid treatment chemical in the porous medium;

a reservoir for holding a supply of the production fluid treatment chemical;

a conduit in fluid communication with the reservoir and at least one of the at least three openings.

65. An apparatus as recited in claim 64 further comprising a metering valve in fluid communication with the conduit for metering the supply of production fluid treatment chemical to the porous medium.

66. An apparatus as recited in claim 64 wherein the reservoir is downhole and retrievable.

67. An apparatus as recited in claim 64 wherein the reservoir is wireline retrievable.

68. An apparatus as recited in claim 64 further comprising a disconnect fitting between the conduit and the reservoir.

69. An apparatus as recited in claim 64 further comprising a perforated tube within the interior space adjacent the porous medium, the perforated tube in fluid communication with the conduit.

70. An apparatus as recited in claim 64 further comprising a branched tube within the interior space in fluid communication with the conduit and having a plurality of openings adjacent the porous medium.

71. An apparatus as recited in claim 64 wherein the downhole reservoir is comprised of the annulus between a production tube and a well casing.

72. An apparatus as recited in claim 71 wherein the well casing has a perforated zone below the reservoir.

73. An apparatus as recited in claim 71 further comprising a packer.

74. An apparatus as recited in claim 73 wherein the packer is a cup packer.

75. An apparatus as recited in claim 64 further comprising means for pressure equalization between the reservoir and the interior space of the chamber such that the chemical agent may flow under the influence of gravity from the reservoir to the interior space.

76. A method for recharging a downhole chemical treatment apparatus having a porous medium for containing a chemical agent comprising:

storing the chemical agent in a downhole reservoir;

flowing the chemical agent via a conduit from the reservoir to a chamber containing the porous medium; and, contacting the porous medium with the chemical agent until at least a portion of the chemical agent is absorbed into the porous medium.

77. A method as recited in claim 76 wherein flowing the chemical agent is accomplished under the influence of a pressurized fluid within the reservoir.

78. A method as recited in claim 76 wherein flowing the chemical agent is controlled by a valve in fluid communication with the conduit.

79. A method as recited in claim 76 further comprising:

retrieving the downhole reservoir;

refilling the reservoir with chemical agent; and, reinstalling the reservoir downhole.

80. A method as recited in claim 79 further comprising recharging the reservoir with a pressurization fluid.

81. An apparatus for the downhole chemical treatment of production fluids comprising:

a chamber having an interior space and at least two openings;

a porous medium within the interior space of the chamber;

a production fluid treatment chemical in the porous medium;

an artificial lift pump having an inlet located below the chamber and in fluid communication with at least one of the at least two openings such that production fluids pass through the interior space and contact the porous medium prior to entering the pump inlet.

82. An apparatus as recited in claim 81 wherein the artificial lift pump is an electric submersible pump.

83. An apparatus as recited in claim 81 wherein the artificial lift pump comprises:

a motor;

a shaft driven by the motor;

a pump driven by the shaft;

a seal around the shaft; and, a fluid inlet concentric with the shaft and in fluid communication with the pump.

84. An apparatus as recited in claim 83 wherein the chamber has a bottom wall in a fluid-tight sealing arrangement with the seal.

85. An apparatus as recited in claim 81 wherein the chamber has a bottom wall in a fluid-tight sealing arrangement with a housing for the motor.

86. An apparatus as recited in claim 81 wherein the artificial lift pump is within the chamber having an interior space.

87. An apparatus as recited in claim 81 wherein the pump has an outlet in fluid communication with a production tube and that is concentric with the chamber having an interior space.

88. An apparatus as recited in claim 81 further comprising a removable top plate on the chamber.

89. An apparatus as recited in claim 81 wherein at least one of the at least two openings comprises a screen.

90. An apparatus as recited in claim 81 wherein the chamber having an interior space comprises a removable section containing the porous medium.

91. An apparatus as recited in claim 90 wherein the removable section is wireline removable from the surface.

92. An apparatus for the downhole chemical treatment of production fluids comprising:

a chamber having an interior space and at least two openings;

a porous medium within the interior space of the chamber;

a production fluid treatment chemical in the porous medium;

a generally annular conduit below the chamber and having a first end in fluid communication with one of the at least two openings of the chamber and a second end, distal from the first end and situated below the first end;

an artificial lift pump having an inlet located below the chamber and in fluid communication with the second end of the generally annular conduit such that production fluids pumped by the artificial lift pump pass through the interior space, contact the porous medium, and subsequently pass through the generally annular conduit prior to entering the pump inlet, the generally annular conduit being of sufficient length to permit at least some gas bubbles entrained in the production fluids to rise within the conduit and avoid being drawn into the pump inlet.

93. An apparatus as recited in claim 92 wherein the pump inlet is configured such that production fluids flowing through the generally annular conduit must change direction in the vertical plane in excess of 90° prior to entering the pump inlet.

94. An apparatus as recited in claim 92 wherein the artificial lift pump is in fluid communication with a production tube concentric with the generally annular conduit.

95. A method for the downhole degassing and chemical treatment of well production fluids which comprises:

absorbing a production fluid treatment chemical into a porous medium;

desorbing the treatment chemical by passing well production fluids across the porous medium;

degassing the well production fluids by passing the well production fluids in a generally downward direction through a conduit having sufficient length to permit at least a partial gas/liquid phase separation prior to pumping the well production fluids from the wellbore.

96. An apparatus for the downhole chemical treatment of production fluids comprising:

a chamber having a first end, a second end, at least two substantially cylindrical, concentric, interior spaces and at least two openings;

a motor connected to the chamber at the first end;

a drive shaft connected to the motor and passing through the chamber;

an artificial lift pump connected to the drive shaft at the second end of the chamber and in fluid communication with at least one of the at least two openings;

a porous medium within at least one of the at least two interior spaces of the chamber;

a production fluid treatment chemical in the porous medium; and, a fluid-permeable screen contiguous with at least one of the at least two openings.

97. An apparatus as recited in claim 96 further comprising a pressure relief valve in fluid communication with the artificial lift pump and responsive to a pressure differential across the fluid-permeable screen.

98. An apparatus as recited in claim 96 further comprising:

a reservoir for holding a supply of production fluid treatment chemical;

a conduit in fluid communication with the reservoir and the interior space of the chamber containing the porous medium; and, a valve connected to the conduit for controlling the flow of production fluid treatment chemical.

99. An apparatus for the downhole chemical treatment of production fluids comprising:

a chamber having a first end, a second end, at least two substantially cylindrical, concentric, interior spaces and at least two openings;

a fluid-permeable screen at least partially separating the at least two interior spaces;

a motor mounted to the chamber at the first end;

a drive shaft connected to the motor and passing through the chamber;

an artificial lift pump connected to the drive shaft at the second end of the chamber and in fluid communication with at least one of the at least two openings;

a porous medium within at least one of the at least two interior spaces of the chamber; and, a production fluid treatment chemical in the porous medium.

100. An apparatus as recited in claim 99 further comprising a filter medium in at least one of the at least two interior spaces of the chamber.

101. A method for precipitating hardness ions in well production fluids downhole comprising:

absorbing a precipitation agent into a porous medium; and, passing well production fluids across the porous medium.

102. A method for the chemical treatment of well production fluids which comprises:

absorbing a production fluid treatment chemical selected from the group consisting of scale inhibitors, corrosion inhibitors, emulsion breakers, surfactants, chemicals that resist the deposition of paraffin, and hydrogen sulfide scavengers into a porous medium; and, passing well production fluids across the porous medium downhole.

* * * * *